US008142376B2

(12) United States Patent
Gueret

(10) Patent No.: US 8,142,376 B2
(45) Date of Patent: Mar. 27, 2012

(54) MASSAGE MEMBER, MASSAGE DEVICE AND PACKAGING AND DISPENSING ASSEMBLY INCORPORATING SUCH A MASSAGE DEVICE

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 1015 days.

(21) Appl. No.: 12/104,005

(22) Filed: Apr. 16, 2008

(65) Prior Publication Data

US 2008/0255484 A1 Oct. 16, 2008

Related U.S. Application Data

(60) Provisional application No. 60/913,898, filed on Apr. 25, 2007.

(30) Foreign Application Priority Data

Apr. 16, 2007 (FR) ..... 07 54497

(51) Int. Cl.
*A61H 15/00* (2006.01)

(52) U.S. Cl. ..... 601/122; 601/123

(58) Field of Classification Search ..... 602/118–123, 602/125–131; 601/118–123, 125–131
See application file for complete search history.

(56) References Cited

U.S. PATENT DOCUMENTS

| | | | | |
|---|---|---|---|---|
| 1,569,426 | A | 1/1926 | Krauthoff | |
| 1,650,528 | A | 11/1927 | Mesterton | |
| 1,872,832 | A * | 8/1932 | Silverberg | 601/141 |
| 1,999,939 | A | 4/1935 | Luzzi | |
| 2,219,086 | A * | 10/1940 | Broberg | 601/118 |
| 2,582,686 | A * | 1/1952 | Fabio | 601/118 |
| 2,691,978 | A | 10/1954 | Kirby | |
| 4,554,911 | A * | 11/1985 | Nielsen | 601/123 |
| 5,218,955 | A | 6/1993 | Gueret | |
| 6,010,432 | A | 1/2000 | Vawter | |
| 2004/0024336 | A1 | 2/2004 | Lin | |
| 2005/0020948 | A1 | 1/2005 | Gueret | |

FOREIGN PATENT DOCUMENTS

| | | |
|---|---|---|
| BE | 428 231 | 6/1938 |
| DE | 444 818 | 5/1927 |
| DE | 36 10 220 | 10/1987 |

(Continued)

OTHER PUBLICATIONS

U.S. Appl. No. 12/511,163, filed Jul. 29, 2009, Gueret.

*Primary Examiner* — Michael A. Brown
(74) *Attorney, Agent, or Firm* — Oblon, Spivak, McClelland, Maier & Neustadt, L.L.P.

(57) ABSTRACT

A massage device includes a support, a grip or gripping means firmly attached to the support and capable of being grasped in order for a user to handle the massage device, and at least two massage members rotatably mounted on the support around respective axes of rotation. The two massage members each typically include a roller that extends along a main axis of elongation, and massage components configured to bear against a skin surface, the massage components including free ends that project outwardly relative to the roller and that are arranged along at least one helix around the main axis of elongation of the roller, the massage components being distributed around at least one turn of the helix, said helix including an irregularity relative to the roller.

22 Claims, 21 Drawing Sheets

FOREIGN PATENT DOCUMENTS

| | | |
|---|---|---|
| DE | 43 14 362 | 11/1994 |
| EP | 1 472 953 | 11/2004 |
| FR | 1.093.828 | 5/1955 |
| FR | 1.335.549 | 7/1963 |
| FR | 2 439 010 | 5/1980 |
| FR | 2 664 158 | 1/1992 |
| FR | 2 854 312 | 11/2004 |
| GB | 274 454 | 5/1928 |
| GB | 880289 | 10/1961 |

* cited by examiner

MASSAGE MEMBER, MASSAGE DEVICE AND PACKAGING AND DISPENSING ASSEMBLY INCORPORATING SUCH A MASSAGE DEVICE

CROSS-REFERENCE TO RELATED APPLICATIONS

This document claims priority to French Patent Application No. 07 54497, filed on Apr. 16, 2007, and U.S. Provisional Application No. 60/913,898, filed on Apr. 25, 2007, the entire contents of both of which are hereby incorporated by reference.

BACKGROUND OF THE INVENTION

1. Field of the Invention

The present invention relates to a massage member, a massage device comprising the member and to a packaging and dispensing assembly equipped with the massage device.

One preferred, but not exclusive, field of the invention relates to the massaging of a skin surface for the purpose of obtaining a muscle relaxant effect for a user.

Another example of the invention relates to softening a skin surface before application of a cosmetic product in order to promote the penetration of this product through the skin layers. It may also improve this penetration into a skin surface pre-coated with a cosmetic product. The skin surfaces massaged may, for example, be the arch of the foot, the legs, the buttocks, the back, the stomach, the arms or the face.

2. Discussion of Background

The expression "cosmetic product" is understood to mean a product such as defined in Council Directive 93/35/EEC of 14 Jun. 1993.

Many devices suitable for massaging a skin surface are listed in the related art.

DE 43 14 362, DE 444 818, GB 274 454, GB 880 289, U.S. Pat. No. 1,569,426, U.S. Pat. No. 1,650,528, U.S. Pat. No. 1,999,939, U.S. Pat. No. 2,691,978, U.S. Pat. No. 6,010,432, U.S. Pat. Pub. No. 2004/0024336, FR 1 093 828, FR 1 335 549, FR 2 439 010, FR 2 664 158 and FR 2 854 312 describe examples of such devices.

FR 2 664 158 describes, in particular, a massage device intended to be applied to the skin that is equipped with at least two massage members rotatably mounted about one respective axis.

Such massage members may comprise an axisymmetric cylinder from which an endless screw relief extends.

However, one drawback linked to the above-noted device of the related art is that the massage member does not provide optimal massaging of the skin surface to be treated. This is because such a member does not make it possible to optimally fold or stretch the skin surface. Furthermore, this member typically does not provide a sufficient vibrating and oscillating action to adequately knead the skin surface.

U.S. Pat. Pub. 2004/0024336 describes a massage device comprising a massage member equipped with a roller joined to a gripping member. This roller comprises a plurality of reliefs arranged in a spiral around the axis of the roller. Such reliefs are arranged along an axis of elongation of the roller behind one another, in a perfectly aligned manner.

However, one drawback linked to this device of the related art is that the massage member provides a somewhat ineffective massage of the skin surface to be treated.

SUMMARY OF THE INVENTION

One objective of an example of the present invention is therefore to overcome at least one of the aforementioned drawbacks.

One objective of an example of the present invention is to provide a massage member capable of exerting a folding and stretching action on the skin surface to be treated that is particularly effective.

In one example, the present invention provides a massage member capable of exerting a vibrating and oscillating action on the massaged skin surface.

In one example, the present invention provides a massage member that has an action on the skin surface that differs depending on the displacement direction of the member.

Certain examples of the invention provide a massage member that is easy to manufacture, that can be produced industrially on a large scale, and that has a low cost price.

One example of the invention provides, according to a first aspect, a massage device comprising a support, grouping means firmly attached to the support capable of being grasped in order to handle the massage device, at least two massage members rotatably mounted on the support around a respective non-parallel or coincident, including common, axis of rotation. The two massage members in this example typically each include, a roller that extends along a main axis of elongation and massage components configured to bear against a skin surface. The massage components include free ends that jut out relative to the roller and that are arranged along at least one helix around the main axis of elongation of the roller. The massage components are typically distributed along at least one turn of the helix. The helix typically includes an irregularity relative to the roller.

Such a mobile device may thus be grasped by the user in order to move the massage member relative to the skin surface to be treated so as to provide a particularly intense massage.

The gripping means may extend along a longitudinal axis that is transverse or oblique to the axis of rotation of at least one massage member.

The device may comprise a first massage member and a second massage member that rotate about different respective axes of rotation. The first and second massage members may each define a helix pitch. The helix pitch of the first massage member may be oriented in the opposite direction relative to the helix pitch of the second massage member. In one example, the first and second massage members may define between them a non-zero angle ($\gamma$). The angle may be less than 180°. The angle is preferably less than 160° and more preferably less than 140°.

Taken independently of, or in combination with, the technical characteristics of the massage device, a second aspect of the invention provides a massage member intended to be mounted onto a support and configured to be rotated on the support about an axis of rotation. This example provides a massage member including a roller that extends along a main axis of elongation and massage components configured to bear against a skin surface. The massage components typically include free ends that jut out relative to the roller and that are arranged along at least one helix around the main axis of elongation of the roller. The massage components are distributed along at least one turn of the helix, and the helix includes a top ridge and an irregularity relative to the roller. The irregularity typically extends opposite the top ridge along the axis of elongation of the roller.

In one example, the same turn may comprise a top ridge and an irregularity relative to the roller. The irregularity may extend opposite the top ridge along the axes of elongation of the roller.

The helix may include two consecutive turns, each comprising a top ridge and an irregularity relative to the roller. The irregularity may extend opposite the top ridge along the axis of elongation of the roller.

The axis of elongation of the roller may be substantially parallel to its axis of rotation.

One or more irregularity of a given axis of elongation may extend opposite one or more top ridge(s) along this axis. In other words, this or these irregularity or irregularities and this or these top ridge(s) may extend along a given row. These irregularities and these top ridges may be arranged alternately along the axis of elongation over at least one part of the length of the roller, or even over the entire length of the roller.

The free ends may define a free edge that juts out relative to the roller. In this case, the free edge juts out relative to a helical groove provided around the main axis of elongation of the roller between the massage components. The irregularity and the top ridge may thus extend to a positive radial direction relative to the roller and relative to the helical groove. In other words, the irregularity may extend a distance in the radial direction greater than the radial distance to which the groove extends relative to the roller.

The irregularity may have, along the helix, a length greater than the internal diameter or external diameter of the roller. Thus, the length measured between two consecutive top ridges may be greater than the diameter of the roller measured from its internal face, or even greater than that measured from its external face. This external face then corresponds to the face from which the massage components extend.

The helix, and more precisely the irregularity, may comprise at least one truncated portion.

The member may include irregularities or truncated portions that are angularly out of line with one another along the main axis of elongation of the roller. One turn or two consecutive turns may include truncated portions that are angularly out of line along the main axis of elongation of the roller. The truncated portions may be out of line by an angle between 5 and 355°, more preferably between 20 and 180° C. and more preferably still between 60 and 120°.

Each turn typically includes between 2 and 25 truncated portions and preferably between 7 and 12 truncated portions.

The massage components may have a thickness that varies relative to the roller. For example, the irregularity may have a variable, where appropriate positive, thickness relative to the roller.

The massage components may include two truncated portions that extend to different respective radial distances relative to the roller.

The massage components may include at least one section plane. The section plane may be parallel or oblique to the main axis of elongation of the roller.

The massage components may include a number of turns greater than or equal to two.

The massage components may define between them a groove around the main axis of elongation of the roller that is, where appropriate, helical and optionally continuous. This groove may be cut into the thickness of the roller. The top ridge and the irregularity may define a free edge that juts out, where appropriate, at any point relative to the roller. This free edge may also optionally jut out relative to the helical groove.

The roller may have a general cylindrical configuration chosen from an axisymmetric cylinder, an elliptical cylinder, a cone or a frustum, for example.

The massage components may have a longitudinal cross-section relative to the longitudinal axis of the roller of trapezoidal shape.

In one example, the massage components have a transverse cross-section taken parallel to the longitudinal axis of the roller having the shape of a parallelogram.

In one example, the massage components may jut out unobtrusively relative to the roller. Such massage components may include a plurality of spikes of variable geometry. The spikes may have a variable shape, length, or width. The spikes may be spaced apart from one another at constant or variable intervals.

In one example, the massage member may furthermore include a blind recess or a through-hole made in or through the massage components.

In one example, the free ends of the massage components may have a surface with a flat, convex, or concave profile.

The massage components may extend perpendicularly or obliquely relative to the main axis of elongation of the roller.

In one example, the massage components may define a substantially constant helix pitch. As a variant, they may define a variable helix pitch.

The helix pitch may be oriented in the same direction over the length of the roller. In one example, the helix pitch may be oriented along at least two different directions over the length of the roller.

In another example, the massage components may be arranged in a double helix.

The free ends of the massage components may be inscribed, at least partly, in a cylindrical envelope that extends around the main axis of elongation of the roller. The axis of rotation of the massage member and the cylindrical envelope may be coaxial. As a variant, they may be off-set from each other.

Other embodiments of the present invention relate to a massage device including at least one massage member according to the second aspect of the invention rotatably mounted on a support.

Another example of the present invention, according to a third aspect, provides a packaging and dispensing assembly including a massage device according to the first or second aspects of the invention, in which the support is attached to a product container equipped with a dispensing orifice.

In one example, the product container may include, at one end, both the dispensing orifice and the massage device. As a variant, the product container may include, at one end, the product dispensing orifice and at an opposite end the massage device.

The dispensing orifice may be sealed by a cover. The cover may be formed by the support.

In one example, the product container may form gripping means of the assembly.

Another example of the present invention, according to a fourth aspect, uses an assembly such as set forth in other examples, in a first step of coating a body surface with a cosmetic product and a second step of massaging the coated body surface.

Another example of the present invention, according to a fifth aspect, uses an assembly such as set forth in other examples, in a first step of massaging a body surface and a second step of coating the massaged body surface with a cosmetic product.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1A:
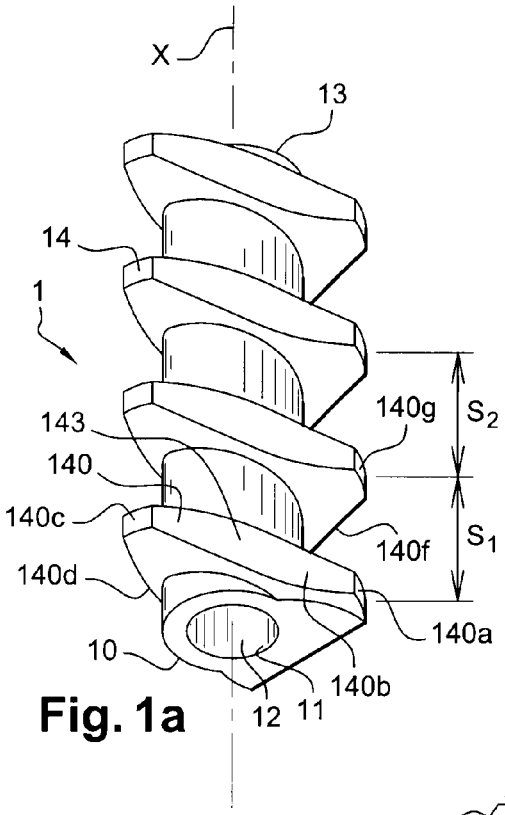
FIG. 1*a* is a partial schematic perspective view of an embodiment of a massage member according to the invention.

Referring now to the drawings, like reference numerals are utilized to designate identical or corresponding parts throughout the several views.

Figure 1B:
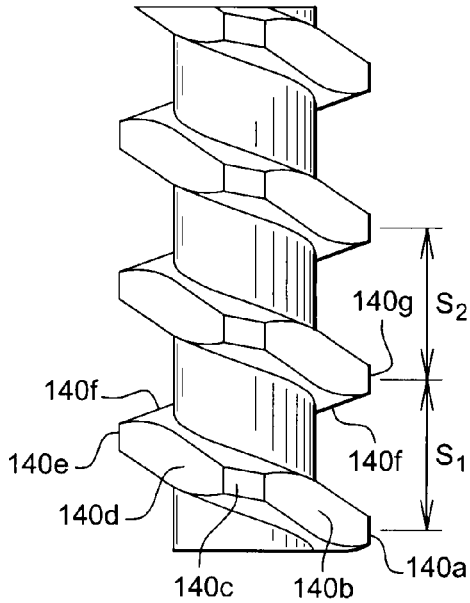
FIG. 1*b* is another partial schematic perspective view of the massage member represented in FIG. 1*a;*
Figure 1C:
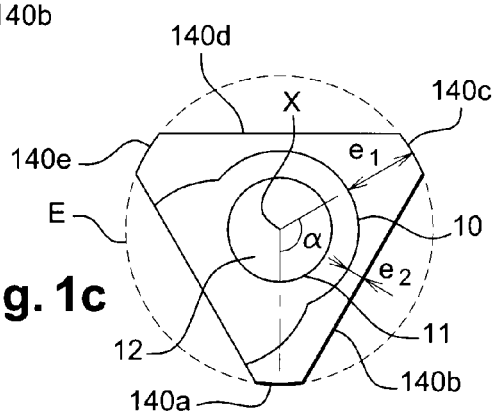
FIG. 1*c* is a schematic side view of the massage member represented in FIG. 1*a;*

FIGS. 1*a*, 1*b*, and 1*c* represent a first exemplary embodiment of a massage member 1 according to the present invention. Such a massage member is intended to be mounted in a rotary manner on a support 2.

In the depicted example the massage member 1 includes a roller 10 and massage components 14.

The roller 10 may be of general cylindrical configuration. This roller may, for example, form an axisymmetric cylinder.

Figure 6:
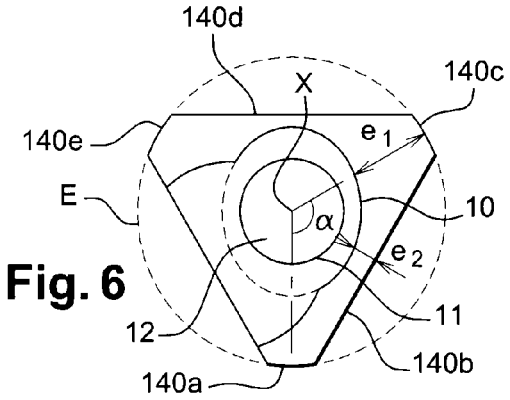
FIG. 6 is a schematic side view of another embodiment of a massage member according to the invention.
Figure 8:
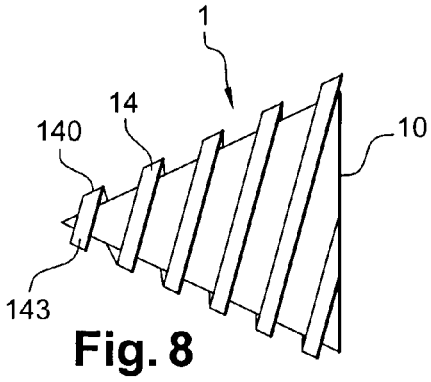
FIG. 8 is a partial schematic side view of another embodiment of a massage member of a device according to the invention.
Figure 9:
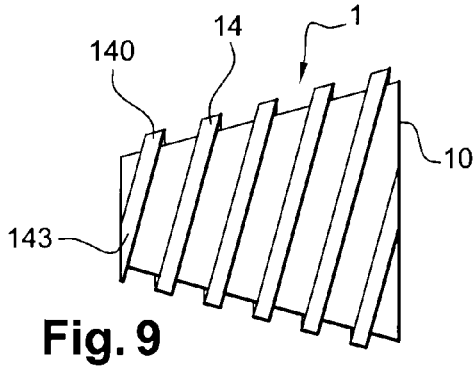
FIG. 9 is a partial schematic side view of another embodiment of a massage member of a device according to the invention.
Figure 12:
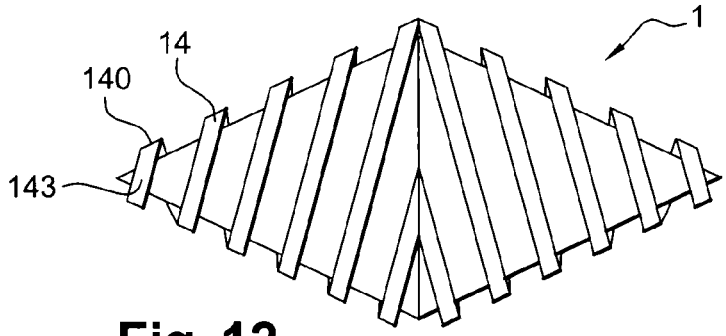
FIG. 12 is a partial schematic side view of another embodiment of a massage member of a device according to the invention.

In other examples, the roller may form an elliptical cylinder as represented in FIG. 6, a conical cylinder as represented in FIG. 8, a frustoconical cylinder as represented in FIG. 9 or be formed from two conical cylinders, for example, arranged head to tail as represented in FIG. 12. These embodiments are not limiting, and other roller shapes may be used.

In the depicted example, the roller 10 extends along a main axis of elongation X. A channel 11 may pass through the inside of this roller. The channel typically extends along the main axis of elongation of the roller. The channel 11 typically includes, at each end, a respective opening 12, 13. The channel 11 may have a cross-section of any suitable shape, for example, circular, elliptical, rectangular, triangular, or other. In one example, the channel may have a cross-section of constant size.

In one example, the openings 12, 13 may open into a respective blind inner housing. According to another example, the roller 10 may be a solid cylinder equipped on both sides with a respective pin.

The massage components 14 are typically configured to bear against a skin surface such as the arch of the foot, the legs, the back, the arms, or else the face.

These massage components 14 typically include free ends 140 that jut out relative to the roller 10 and that are arranged along at least one helix around the main axis of elongation X of the roller. Thus, these massage components may extend radially relative to the main axis of elongation of the roller.

According to the depicted example, the massage components 14 are spread along at least one turn, and the helix exhibits an irregularity relative to the roller 10.

The term "turn" should be understood as meaning that the massage components are arranged in a helix that extends over at least one complete revolution, thus going from 0 to 360° around the main axis of elongation. According to one embodiment, the massage components extend over two or more turns. In FIG. 1, the massage components extend over three and a half turns. By way of example, two turns have been referenced S1, S2.

The term "irregularity" should be understood as meaning that the helix formed by the free ends of the massage components has at least one alteration relative to a conventional helix profile and in particular relative to a circular, elliptical, or conical helix profile. This irregularity may correspond to a portion that is truncated relative to such a helix profile. Conversely, the irregularity could include one or more portions that are prominent relative to this helix profile.

In the example represented in FIGS. 1*a*, 1*b*, and 1*c*, the massage components comprise a plurality of truncated portions.

For reasons of clarity, the truncated portions of the turn S1 have been denoted by numerical references. This turn comprises in this example truncated portions 140*b*, 140*d* and 140*f*. More generally, each turn may comprise between 1 and 25 truncated portions and preferably between 7 and 12 truncated portions.

As shown in the examples depicted in FIGS. 1*a* and 1*b*, the truncated portions may respectively be separated from one another by respective top free ends or top ridges 140*a*, 140*c*, 140*e*, 140*g*. Each top ridge may thus connect two adjacent truncated portions.

The term "top ridge" should be understood as signifying that the helix includes portions which, relative to the roller, have a thickness greater than that defined by the irregularities or truncated portions. In other words, these top ridges can extend, relative to the roller, to a height or radial distance greater than that to which the irregularities or truncated portions extend. These top ridges thereby define the first portions of the roller to come into contact with the skin surface to be treated.

Figure 2:
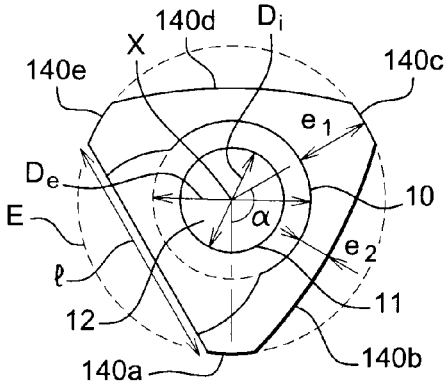
FIG. 2 is a schematic side view of another example of a massage member according to the invention.
Figure 3:
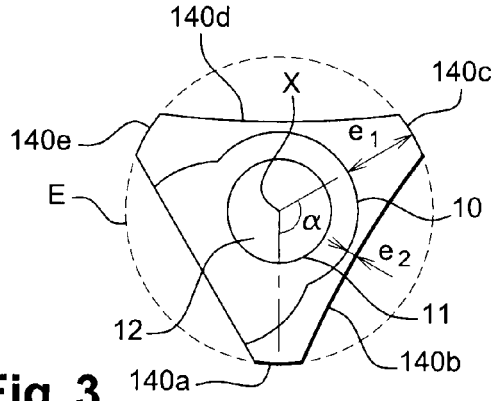
FIG. 3 is a schematic side view of one example of a massage member according to the invention.

In FIGS. 1*a*, 1*b*, and 1*c*, the massage components include free ends 140, and truncated portions such as 140*b*, that are substantially planar relative to the main axis of elongation X of the roller. In FIG. 2, the massage components include free ends 140, and in particular truncated portions such as 140*b*, that have a convex surface. In the example depicted in FIG. 3, the massage components comprise free ends 140, and in particular truncated portions such as 140*b*, that have a concave surface.

It can also be observed in FIG. 2 that the roller may have an internal diameter Di and an external diameter De. At least one truncated portion may have, along the helix, a length greater than the value of the internal diameter or even the external diameter.

Figure 7:
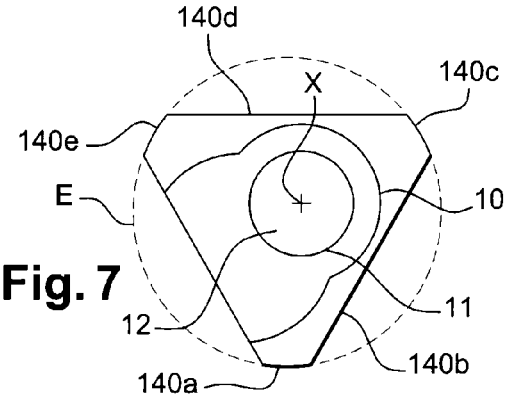
FIG. 7 is a schematic side view of another embodiment of a massage member according to the invention.

As represented in FIG. 1*c*, these top ridges may be inscribed at least partly in a cylindrical envelope E that extends around the main axis of elongation X of the roller 10. This envelope and this roller may be coaxial. In the example represented in FIG. 7, the top ridges are off-centered.

The truncated portions may be defined as a massage component portion that lacks material compared to a typical helix profile, for example, compared to a circular, conical, or elliptical helix profile. The typical helix profile may thus pass through the peak of the top ridges.

The massage components 14 may therefore have a thickness that varies relative to the roller 10. The massage components may thus comprise at least two free ends 140 that extend to different respective radial distances e1, e2 relative to the roller 10. In FIG. 1*c*, e1 represents the distance between the roller 10 and the top ridge 140*c* while e2 represents the distance between the roller 10 and a median part of the truncated portion 140*b*. As can be seen in these figures, e1 may be around three times larger than e2. Of course, this ratio could be less than or greater than this number.

Figure 4:
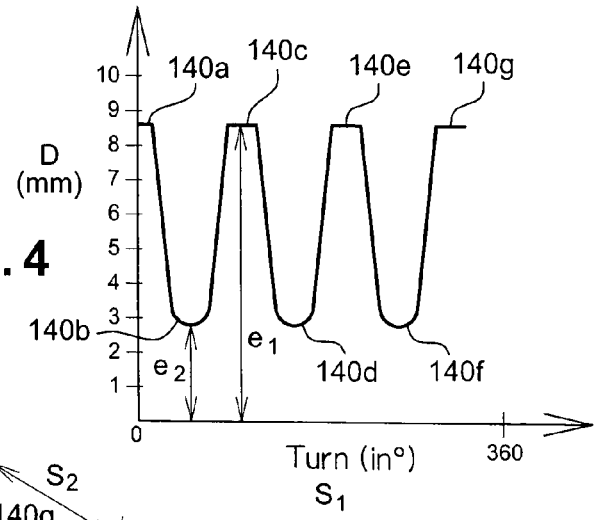
FIG. 4 is a graph illustrating the structure of the massage member represented in FIG. 1*a;*

FIG. 4 depicts a graph representing the radial distance D in millimeters that separates the free ends 140 from the massage components of the roller as a function of their angular position on the turn S1 in degrees. The profile of this curve is started from a top ridge, such as the ridge 140*a*, and is terminated after a helical movement of 360°.

As shown in FIG. 4, the top ridges 140*a*, 140*c*, 140*e*, 140*g* and the truncated portions 140*b*, 140*d*, 140*f* may together define a free edge 143 that juts out substantially at any point relative to the roller 10. Such a free edge may therefore be prominent relative to the roller continuously. Thus, the top ridges and the truncated portions may all extend a positive distance away from the roller.

In this example, the massage components 14 define a substantially sinusoidal curve. These massage components may, for example, comprise more than three waves per turn. These massage components may more generally comprise between 1 and 30 sinusoidal waves per turn. When the envelope E and the roller 10 are coaxial, the sinusoidal waves recorded attest to the presence of irregularities.

Specifically, for example, in the case of a roller in the shape of an axisymmetric cylinder which comprises massage components with free ends spread along a perfectly circular helix profile as is the case in document FR 2 664 158, these free ends extend equidistant from the roller and the graph corresponding to the graph shown in FIG. 4 would then be a straight line parallel to the x-axis.

Furthermore, it should be noted that certain truncated portions according to some examples of the invention extend to be flush with the roller 10 or even into the thickness of this roller. In this case, the truncated portions 140*b*, 140*d*, and 140*f* have at least one segment that extends to a zero or negative radial distance compared to the roller 10.

It should be noted that a shape of a top ridge or a truncated portion of one unit may be common to a shape of a top ridge or a truncated portion of a consecutive unit.

In order to better define the shapes of the massage components, reference will be made in the remainder of the description to a "unit". Such a unit may be repeated along the roller. This unit corresponds to a helix portion. It may, for example, be observed by visualizing the massage member from the side, that is to say, along a direction perpendicular to the main axis of elongation X of the roller. Such units may extend obliquely or perpendicular relative to the main axis of elongation X of the roller.

In the exemplary embodiment represented in FIGS. 1*a*, 1*b*, and 1*c*, these units all have a general triangular shape. By considering two top ridges of one and the same unit, such as the ridges 140*a* and 140*c*, these ridges may be separated from one another by an angle α of around 120°. In such a case, the ridges 140*a*, 140*c*, and 140*e* approximately form the vertices of a triangle. The truncated portions of one and the same unit may also be offset by the same angle α.

Furthermore, it can be observed in these figures that the truncated portions and the top ridges of one unit may be aligned relative to the respective truncated portions and top ridges of the consecutive unit. For example, the top ridge 140*a* may be perfectly aligned with the top ridge 140*g*. In other words, a first irregularity of the helix may extend opposite at least a second irregularity along an axis of elongation of the roller. These two irregularities may be consecutive along the axis of elongation of the roller and be separated from one another by an optionally helical groove 17.

Figure 5A:
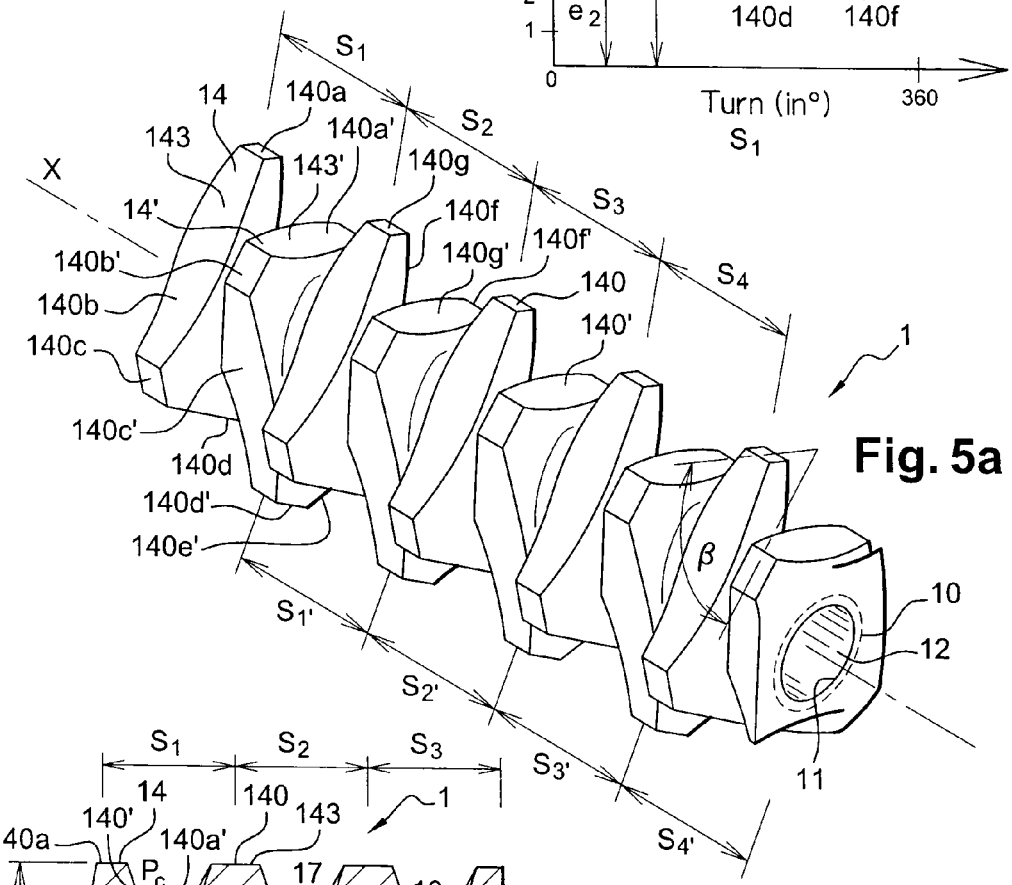
FIG. 5*a* is a partial schematic perspective view of another embodiment of a massage member according to the invention.

FIG. 5*a* shows a massage member having massage components 14, 14' spread along a double helix that extends around the main axis of elongation X of the roller 10.

In this example, the massage components 14' have an identical unit to the unit defined by the massage components 14. The description made with reference to the massage components 14 is therefore also applicable to the massage components 14'. Identical numerical references provided with a prime sign are attributed to the parts of the massage components 14' similar to the parts of the massage components 14.

In such an embodiment, the units of the massage components 14' may be alternated with the units of the massage components 14 along the longitudinal axis X of the roller 10.

It should be noted that the massage components 14' could have a unit different from the unit defined by the massage components 14.

In this embodiment, the massage components 14 are arranged along a first helix that extends over 4 turns referenced S1, S2, S3, and S4 and the massage components 14' are arranged along a second helix that extends over 4 turns referenced S1', S2', S3', and S4'.

In this figure, it can be observed that the truncated portions of one helix may be angularly offset compared to the truncated portions of the other helix relative to the main axis of elongation X of the roller. Thus, at least one irregularity, or truncated portion, may extend opposite at least one top ridge along an axis of elongation of the roller. Along this axis, the at least one irregularity and the at least one top ridge may be separated from one another by an optionally helical groove 17.

In relation to a truncated portion of one unit and a truncated portion of a consecutive unit along the longitudinal axis of the roller 10, such as the portions 140*b* and 140*a'*, the latter may be angularly out of line with one another. Such portions may, for example, be offset by an angle β of 60°. In one example, this angle is between 5 and 355°, more preferably between 20 and 180°, and more preferably still between 60 and 120°. Such an angular offset may be repeated all along the longitudinal axis X of the roller 10.

Similarly, the top ridges of two consecutive units, such as the ridges 140*a* and 140*b'*, may then also be out of line with one another. In this example, the ridges are also out of line with one another by an angle β of around 60°.

It should be noted that such an angular offset of the truncated portions could also be obtained with massage components arranged in a single helix.

In FIGS. 1*a*, 1*b*, and 1*c*, the massage components 14 define a helix pitch oriented in one and the same direction over the length of the massage member. As shown in the depicted example, the helix pitch may be constant along the main axis of elongation X of the roller 10.

Similarly, in the depicted example, the massage components 14, 14' define a respective helix pitch that is substantially constant, oriented in one and the same direction over the length of the massage member.

Figure 13:
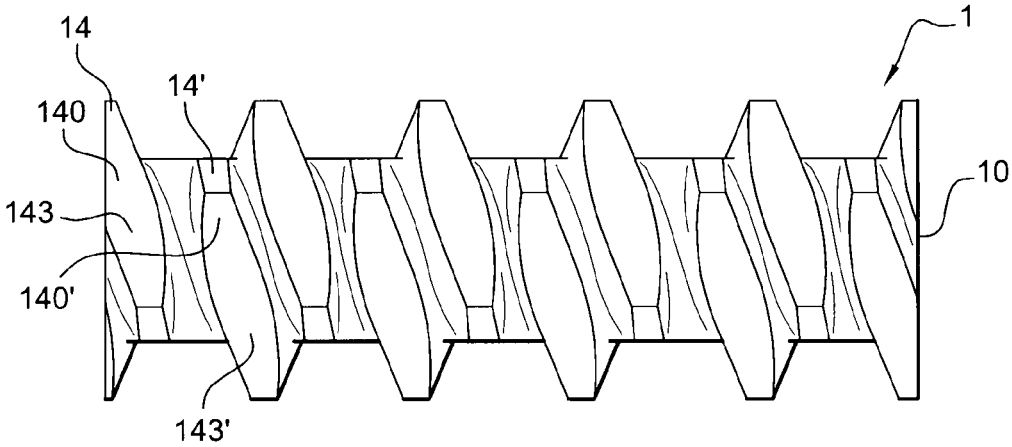
FIG. 13 is a partial schematic side view of another embodiment of a massage member of a device according to the invention.
Figure 14:
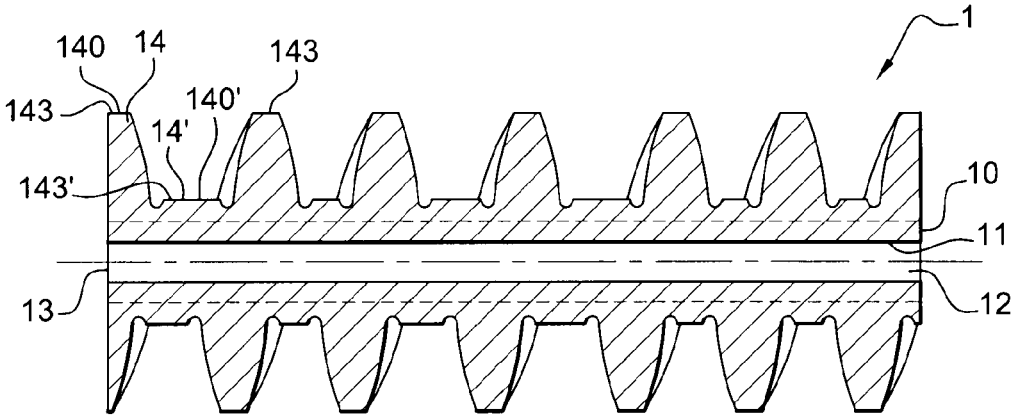
FIG. 14 is a longitudinal cross-sectional view of the massage member represented in FIG. 13.

In the examples shown in FIGS. 13 and 14, the massage components 14, 14' define a helix pitch oriented in one and the same direction over the length of the massage member which is variable. In other words, the massage components of one turn extend over a length of the massage member that is different compared to the massage components of another turn.

Figure 10:
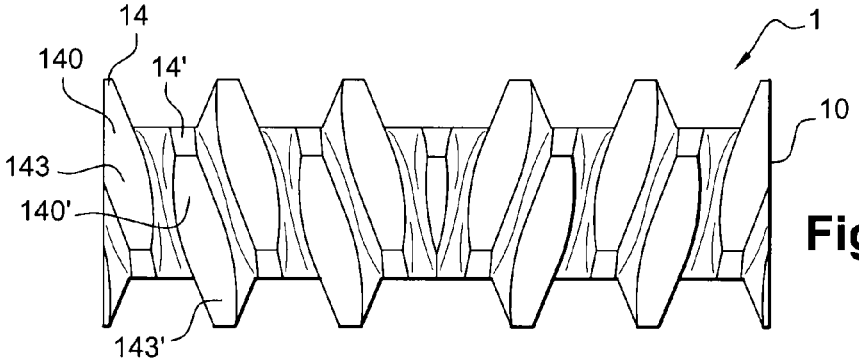
FIG. 10 is a partial schematic side view of another embodiment of a massage member of a device according to the invention.
Figure 11:
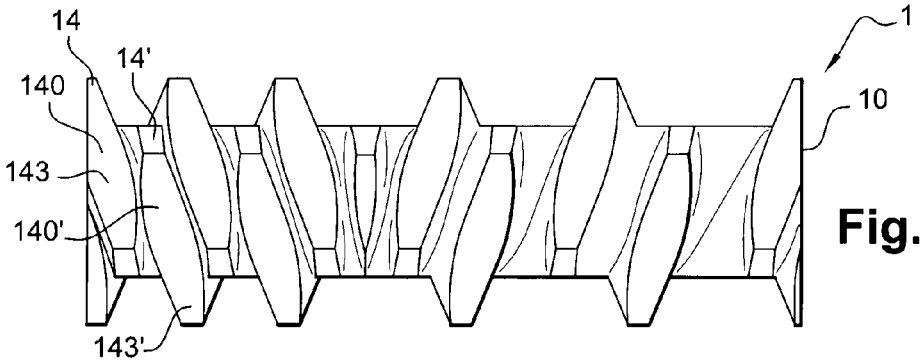
FIG. 11 is a partial schematic side view of another embodiment of a massage member of a device according to the invention.

In the examples shown in FIGS. 10 and 11, the massage components 14, 14' define a helix pitch oriented along at least two different directions over the length of the massage member. In these examples, the helix pitches are oriented away from one another. The massage member thus has one helix pitch oriented towards the left and one helix pitch oriented towards the right in the depicted example.

In FIG. 10, these helix pitches are both constant. In the example shown in FIG. 11, the helix pitch oriented towards the left is constant whereas the helix pitch oriented towards the right is variable, and in this example is increasing.

Figure 5B:
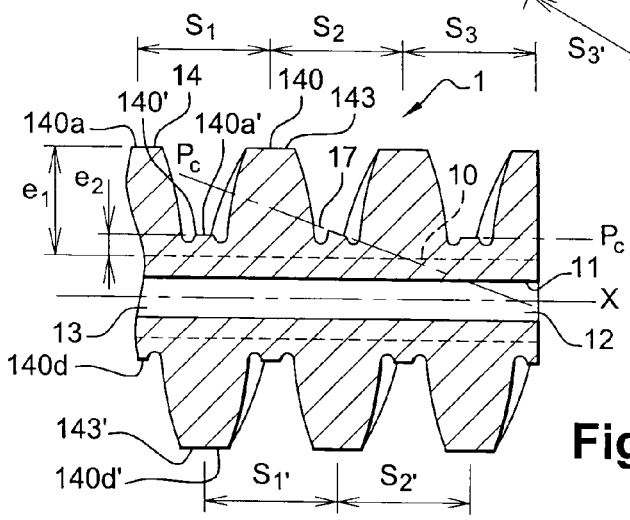
FIG. 5*b* is a longitudinal cross-sectional view of the massage member represented in FIG. 5*a;*

As shown in FIG. 5*b* the massage components 14 may comprise at least one section plane Pc. This section plane may be substantially parallel or oblique to the main axis of elongation X of the roller 10. Such a section plane may thus truncate one part of the helix so as to form an irregularity in this helix.

Furthermore, this figure shows that by making a longitudinal cut in the main axis of elongation X of the roller 10, the massage components 14 may have a trapezoidal shape. In some examples, the massage components have a substantially rectangular shape or other shape.

Moreover, it can be observed that the massage components 14, 14' may define, between them, a continuous, optionally helical, groove 17. The groove 17 may be cut into the thickness of the roller 10. This groove may, for example, extend at a zero or negative radial distance relative to the roller 10. The radial distance of an irregularity, or truncated portion, such as 140*a*', relative to the roller 10 may be zero or, as represented in this FIG. 5*b*, positive. The radial distance of an irregularity relative to the roller 10 may be greater than or equal to that defined by the groove 17. The radial distance of a top ridge relative to the roller 10 is typically greater than that defined by a truncated portion, and also greater than that defined by the groove 17.

In the example depicted in FIG. 5*b*, it may also be observed that at least one truncated portion 140*a*' typically extends between two top ridges 140*a*, 140*g* along the axis of elongation X of the roller. This truncated portion typically rises up from at least one groove 17, and where appropriate, from two grooves. In other words, the at least one groove 17 may extend between a top ridge 140*a* and a truncated portion 140*a*'. When two grooves 17 are provided, they typically extend on both sides of the truncated portion 140*a*'. Thus, this truncated portion may be bordered by at least one groove, and where appropriate by two grooves, which are optionally helical, around the main axis of elongation of the roller 10. As illustrated, the truncated portion 140*a*' can extend to a radial distance e2 relative to the roller 10 that is greater than that to which the at least one groove extends, and where appropriate greater than that to which the two grooves extend.

FIGS. 15 to 29 represent other embodiments of a massage member according to the invention comprising massage components 14 having units different from that described previously.

Figure 15:
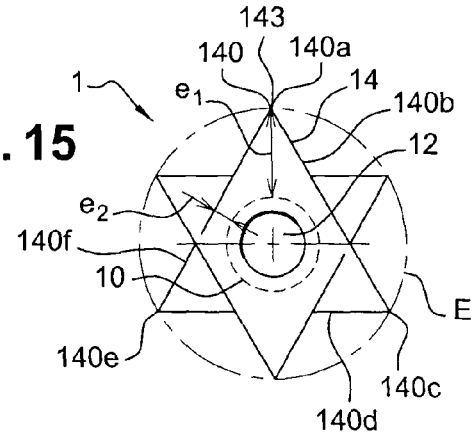
FIG. 15 is a schematic side view of another embodiment of a massage member of a device according to the invention.
Figure 16:
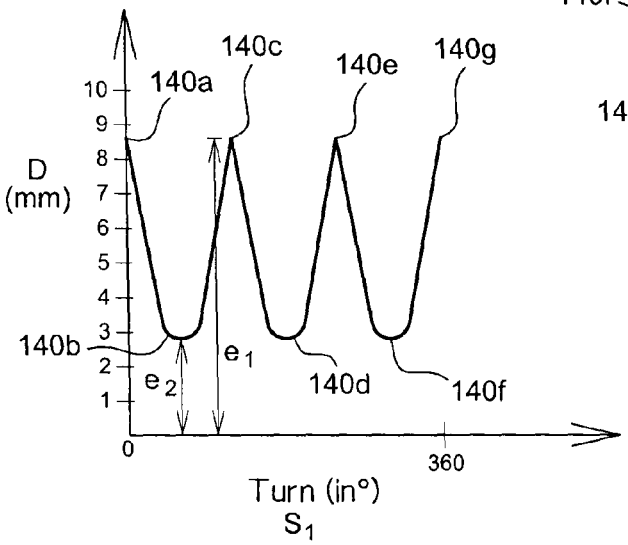
FIG. 16 is a graph illustrating the structure of the massage member represented in FIG. 15.

In FIG. 15, the massage components 14 are arranged in a double helix. They are differentiated from those represented in FIG. 5*a* in that the top ridges have a pointed shape. the depicted massage components have a perfectly triangular unit. As can be seen in FIG. 16, the massage components define a pointed peak or sawtooth sinusoidal curve. The massage components can, for example, comprise three waves per turn.

Figure 17:
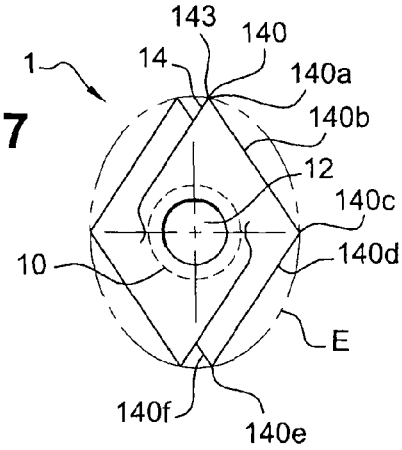
FIG. 17 is a schematic side view of another embodiment of a massage member of a device according to the invention.

In FIG. 17, the massage components 14 are arranged in a double helix. They are differentiated from those represented in FIG. 5*a* in that they have a unit of a generally lozenge shape. Such units thus each comprise four top ridges of substantially pointed shape. Although in this example the top ridges are pointed, they can also have a flat or curved surface. The angle α can, for example, be 60° and the angle β may be 30°.

Figure 18:
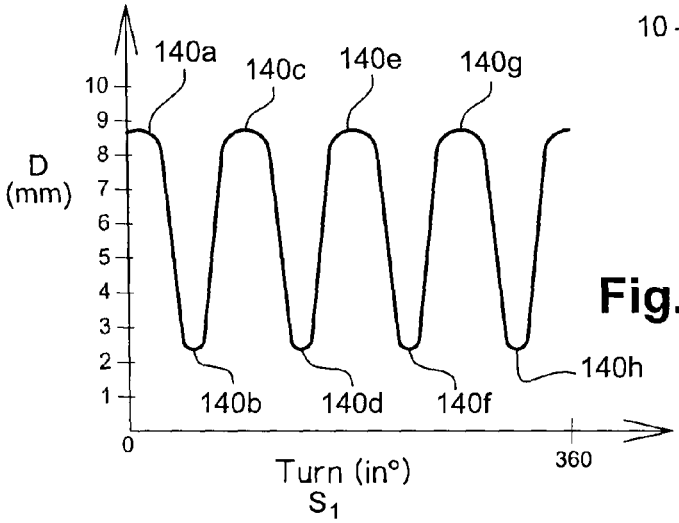
FIG. 18 is a graph illustrating the structure of the massage member represented in FIG. 17.

As can be seen in FIG. 18, the massage components may define a sinusoidal curve having four waves.

Figure 19A:
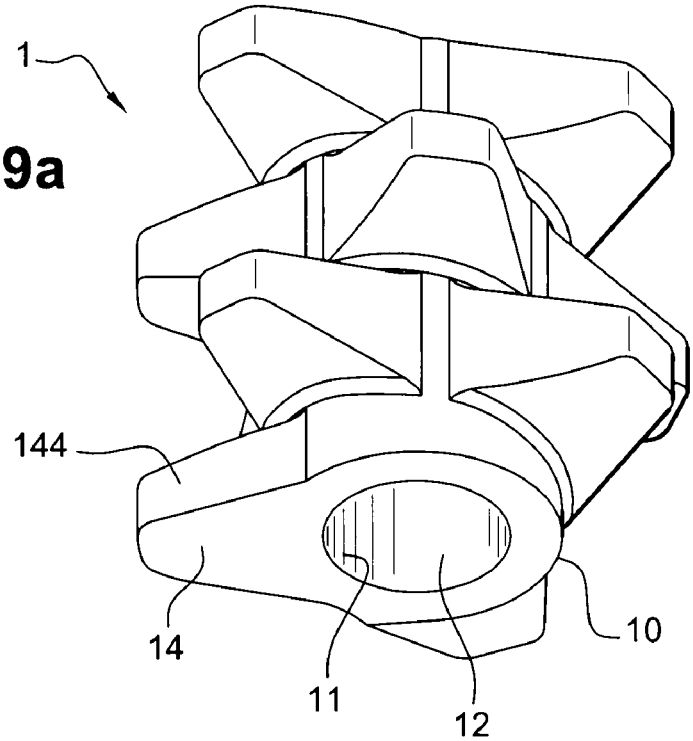
FIG. 19*a* is a partial schematic perspective view of another embodiment of a massage member of a device according to the invention.
Figure 19B:
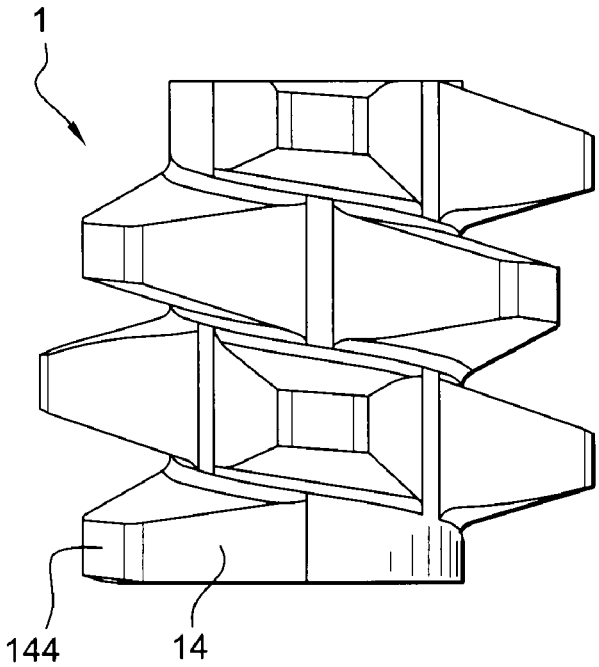
FIG. 19*b* is another partial schematic perspective view of another embodiment of a massage member of a device according to the invention.

In FIGS. 19*a* and 19*b*, the massage components 14 are differentiated from those represented in FIG. 1*a* in that they jut out radially in an unobtrusive manner relative to the roller 10. In the depicted example, the massage components thus comprise a plurality of spikes or fingers 144 spaced apart from one another relative to the main axis of elongation X of the roller.

The depicted spikes have a cross-section taken parallel to the longitudinal axis of the roller having a shape other than circular, and in one example, having a parallelogram shape. It should be noted that this shape may also be found when a cross-section is taken through the massage components such as represented in FIG. 1*a*, comprising free ends that define a free edge 143 that juts out substantially at any point relative to the roller 10.

In one example, each spike may have a substantially pyramidal general shape. This pyramid may comprise a truncated peak. It may have a parallelogram base. As illustrated in FIG. 19*a*, the massage components may have an identical shape, length, and width.

Figure 20:
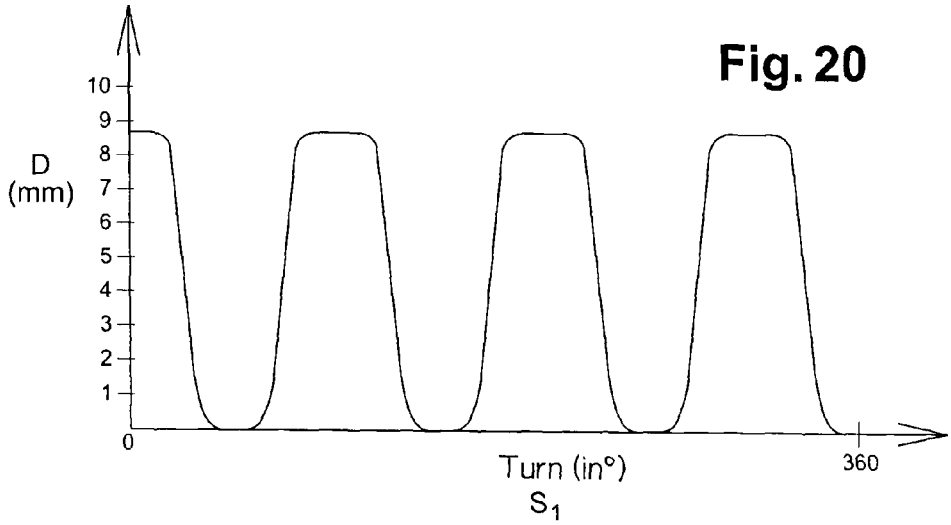
FIG. 20 is a graph illustrating the structure of the massage member represented in FIGS. 19*a* and 19*b;*

In the example shown in FIG. 20, the massage components define, on the graph, a plurality of peaks or humps that are identical and distant from one another. These peaks typically extend from the x-axis. Such a massage member can, for example, include between 3 and 30 peaks per turn and more generally between 4 and 15 peaks per turn.

It should be noted that the massage elements may include a plurality of spikes 144 of variable geometry. Such spikes can have a variable length, shape and/or width.

Although, in this example, the spikes are spaced apart from one another at constant intervals, they can also be spaced apart at variable intervals.

According to another embodiment, the spikes are arranged in a double helix.

In the examples shown in FIGS. 21*a*, 21*b*, 21*c*, 22, 23, and 24, the massage components 14 are differentiated from those represented in FIG. 5*a* in that they have a multilobar general shape.

Figure 21A:
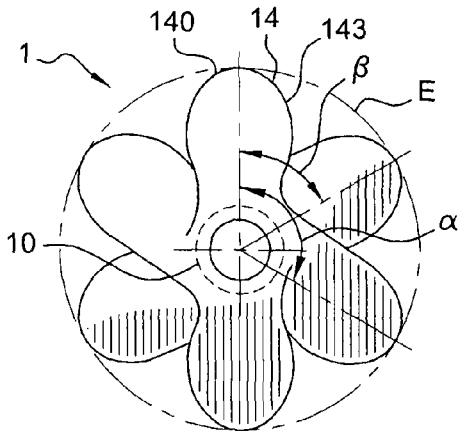
FIG. 21*a* is a schematic side view of another embodiment of a massage member of a device according to the invention.

In the example shown in FIG. 21*a*, the massage components are arranged in a double helix. They have units with three lobes or petals. Such units are expressed on the graph on FIG. 22 as a perfectly sinusoidal curve having relatively wide waves. These massage components typically, for example, include three waves per turn.

Figure 21B:
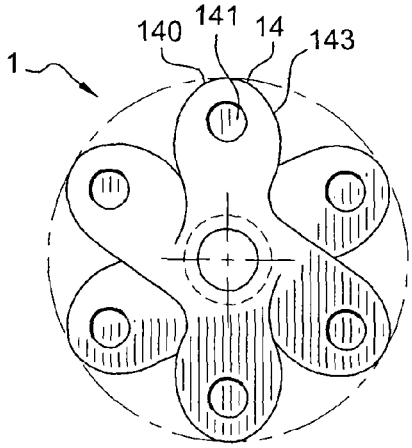
FIG. 21*b* is a schematic side view of another embodiment of a massage member of a device according to the invention.

In FIG. 21*b*, the massage components are differentiated from those described with reference to FIG. 21*a*, in that their lobes include blind recesses or cavities 141. Such recesses are typically located at a distance from the free end of the massage components. In one example, these recesses are provided substantially in the center of the lobes. Such recesses typically confer a certain deformability to the massage components and especially a certain elasticity.

Figure 21C:
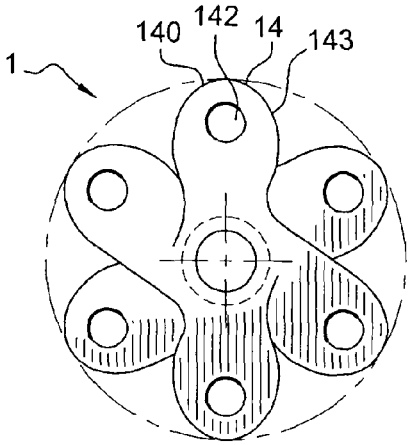
FIG. 21*c* is a schematic side view of another embodiment of a massage member of a device according to the invention.
Figure 22:
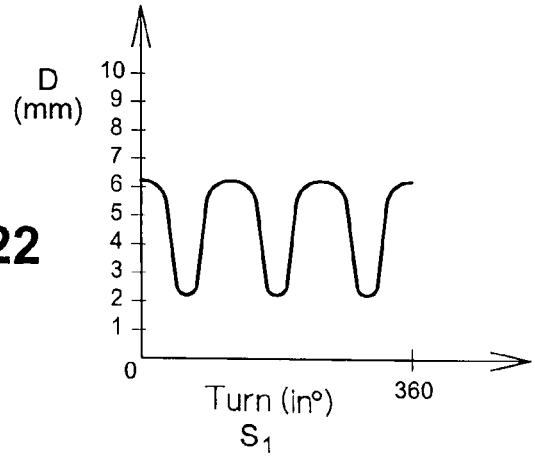
FIG. 22 is a graph illustrating the structure of the massage member represented in FIG. 21*a;*

In the example shown in FIG. 21*c*, the massage components are differentiated from those described with reference to FIG. 21*b* in that they include through-holes 142. In other words, such holes form orifices that extend through the lobes and thus confer an increased deformability on these massage components. Such holes can extend along an axis parallel or oblique to the main axis of elongation X of the roller.

It should be noted that these recesses or holes can be provided in other units of massage components 14.

Figure 23:
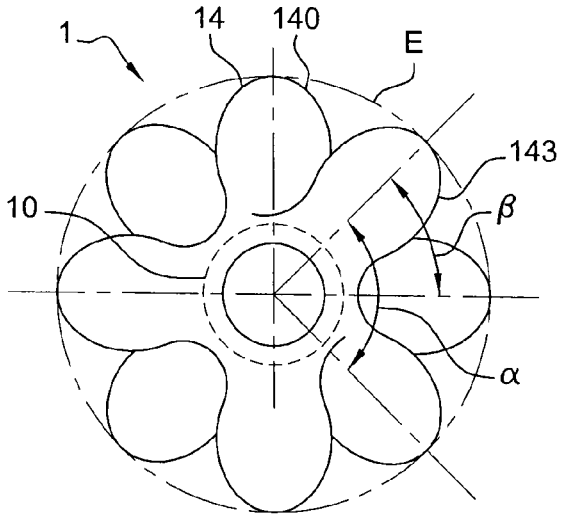
FIG. 23 is a schematic side view of another embodiment of a massage member of a device according to the invention.

In the example shown in FIG. 23, the massage components are arranged in a double helix. They have units with four lobes or petals. The angle α can typically, for example, be 60°, and the angle β can typically be 30°.

Figure 24:
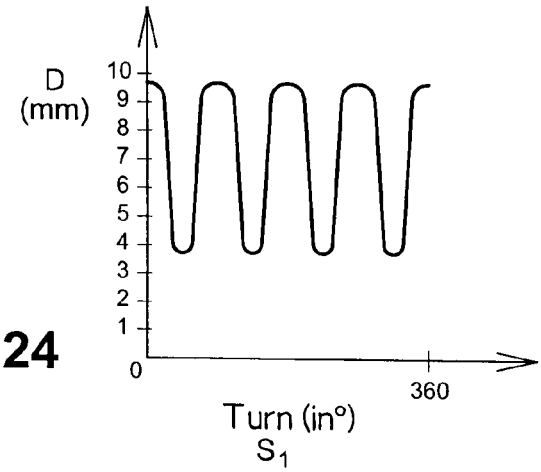
FIG. 24 is a graph illustrating the structure of the massage member represented in FIG. 3.

Such units are expressed on the graph depicted in FIG. 24 by a perfectly sinusoidal curve that has relatively narrow waves. In other words, the frequency of these waves is higher. These massage components can, for example, include four waves per turn.

The units described with reference to FIGS. 15 to 24 may be provided for massage components arranged in the form of a single helix. Furthermore, the units described are not limiting, other massage component units are available such as units having a general square shape or other shapes.

Figure 25:
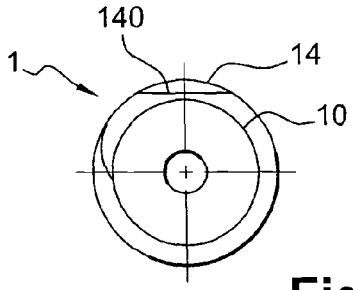
FIG. 25 is a partial schematic side view of another embodiment of a massage member of a device according to the invention.
Figure 26:
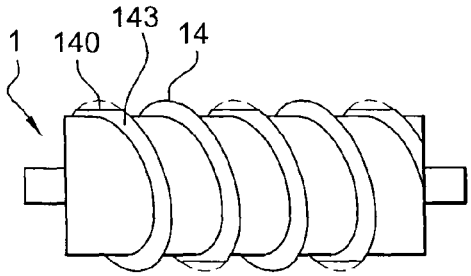
FIG. 26 is a schematic front view of the massage member represented in FIG. 25.
Figure 27:
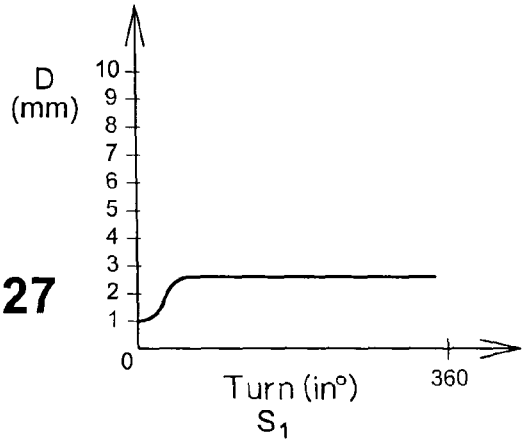
FIG. 27 is a graph illustrating the structure of the massage member represented in FIG. 6.

In FIGS. 25 to 27, the massage components 14 are arranged in a circular helix comprising a plurality of truncated portions. The missing portions of material from the massage components relative to the ideal circular helix profile have been represented in FIG. 26 by dotted lines. The massage components then have a truncated disc unit. Thus, the truncated portions may be assimilated into this embodiment having one or more flat spots.

As illustrated in FIG. 26, the massage components 14 can, for example, include one or two truncated portions per turn. This number may of course be modified and may especially be higher. As can be seen in FIG. 27, the curve resulting from such a unit may comprise a plateau which subsides at the truncated portions.

Figure 28:
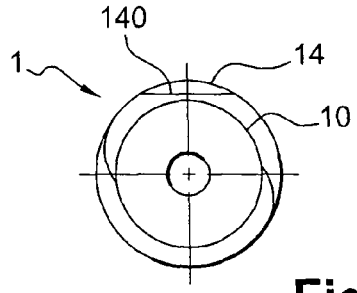
FIG. 28 is a partial schematic side view of another embodiment of a massage member of a device according to the invention.
Figure 29:
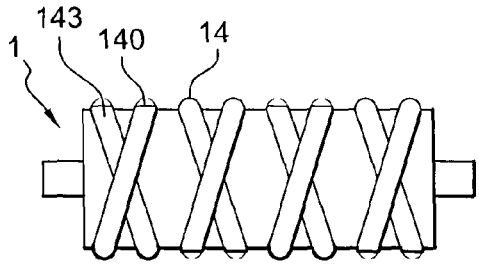
FIG. 29 is a schematic front view of the massage member represented in FIG. 28.

In FIGS. 28 and 29, the massage components 14 are differentiated from the massage components illustrated in FIGS. 25 to 27 in that they are arranged in a double circular helix including a plurality of truncated portions. These massage components may, for example, include one or two truncated portions per turn, represented here too by dotted lines, that can be seen in FIG. 29.

It should be noted that the roller 10 and the massage components 14 may be made from the same material or from different materials. The roller may, for example, be made from a substantially rigid material and the massage components from a substantially flexible material.

In some examples, massage member 1 is preferably made of wood, metal, glass, a rigid plastic, an elastomer, PE, PET, POM, PA, PS, PP or PE, or made from silicone, nitrile rubber, EPDM, EVA, PVC, PU, latex, butyl rubber, or from thermoplastic elastomers such as HYTREL®, PEBAX®, or SANTOPRENE®.

Figure 31:
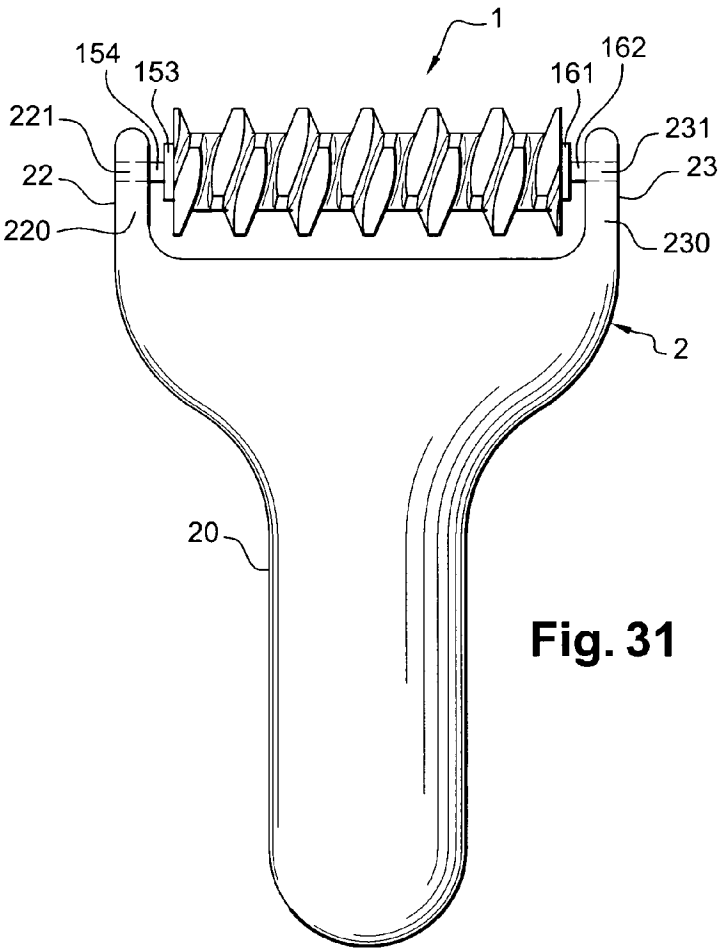
FIG. 31 is a schematic front view of the massage device represented in FIG. 30.
Figure 30:
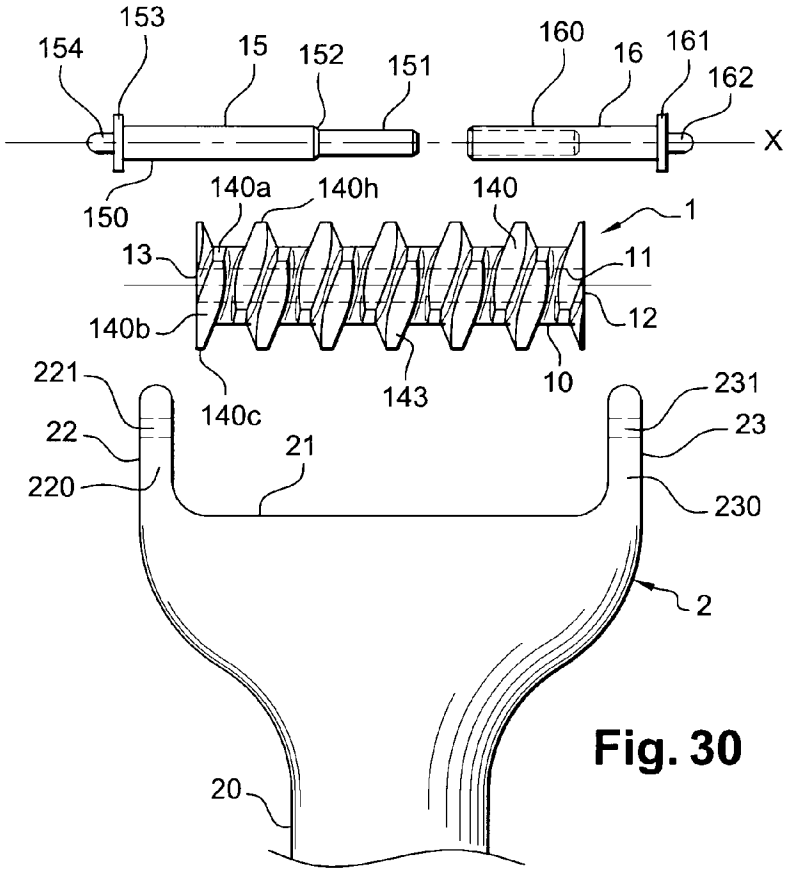
FIG. 30 is a slightly exploded schematic side view of an embodiment of a massage device according to the invention.

FIGS. 30 and 31 represent an exemplary embodiment of a massage device according to the present invention. The depicted device may, for example, include one or more massage members 1 such as represented in FIG. 5*a* combined with a support 2.

The support 2 may comprise a body 20 and attachment means 22, 23.

The body 20 may form gripping means for a user. This body may, for example, have a general oblong, and in one example, oval, shape.

The attachment means 22, 23 may be fixed to the body 20. In particular, the attachment means 22, 23 may be produced as the same part with the body 20 or may be attached by any suitable means to this body.

In this exemplary embodiment, the attachment means 22, 23 stand up from one end 21 of the body.

The attachment means 22 typically include two posts or arms 220, 230 respectively that extend in a diametrically opposed manner from this end 21. These posts may each be provided with a respective orifice 221, 231. These orifices may be opposite one another. Such orifices may be blind or through-holes.

The openings 12, 13 may receive a respective coupling 16, 15. The coupling 15 may comprise a first section 150 connected by an internal step or narrowing 152 to a second section 151. The second section 151 may thus have a cross-section with a smaller size than that of the first section 150. The coupling 16 may itself have a size that it can be mounted by tightly fitting over the second section 151.

Each coupling may be equipped with positioning means 153, 161. These positioning means may stop the couplings 15 and 16 from sinking into the channel 11. Such positioning means may, for example, include a flange or disc having a diameter greater than that of the openings 12, 13.

As shown in the example depicted in FIG. 30 these flanges may both include a pin 154, 162. The orifices 221, 231 make it possible to respectively house the pins 154 and 162 in order to mount the massage member 1 onto the support 2. Once mounted, the massage member can be rotated relative to the support 2 about an axis of rotation Y. The couplings 15, 16 thus form a rotating shaft.

It should be noted that other means are available for producing such a shaft. In particular, the massage member can be mounted onto a shaft made from a single part. This shaft typically includes any suitable retention means to limit its movement relative to the support 2 in the main axis of elongation X of the roller 10.

This axis of rotation Y may merge with the main axis of elongation X of the roller 10.

The gripping means formed by the body 20 may extend along a longitudinal axis transverse or oblique to the axis of rotation Y of the massage member 1.

FIGS. 32 to 44 represent various embodiments of a massage device according to the present invention.

Figure 32:
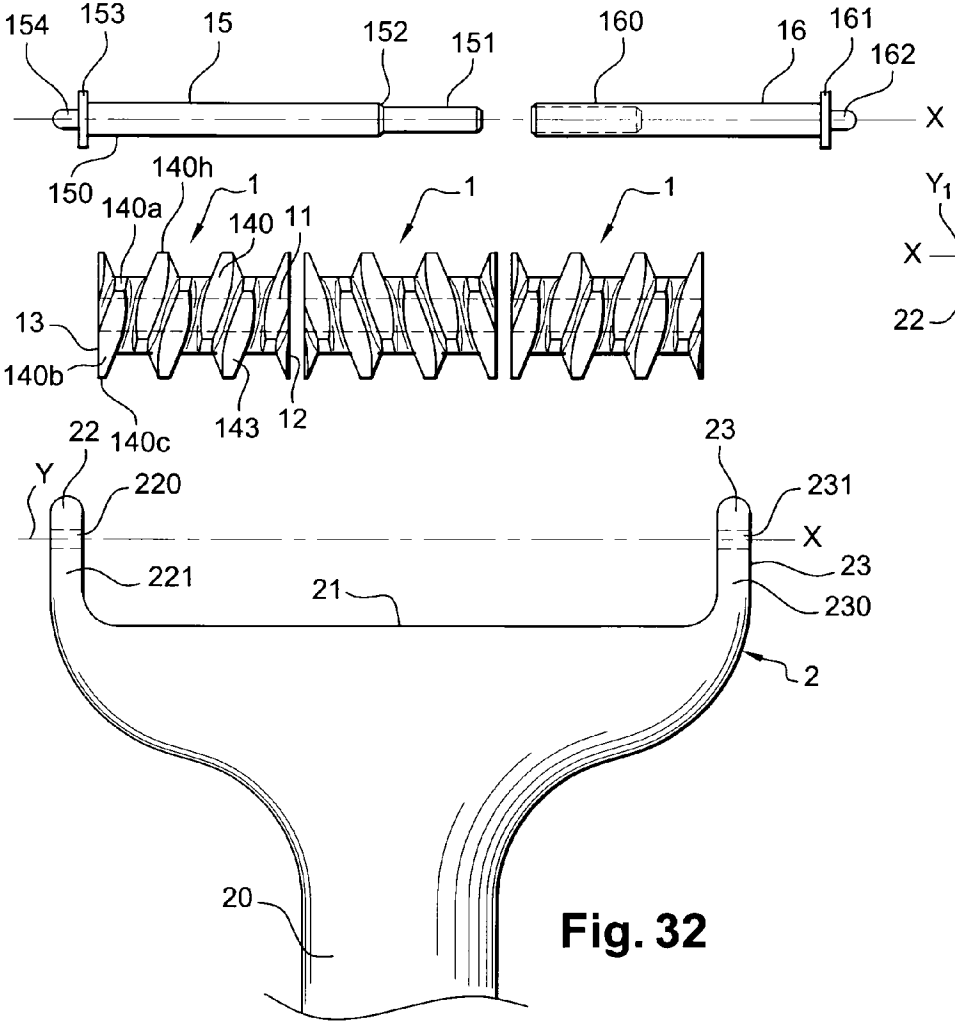
FIG. 32 is an exploded schematic front view of another embodiment of a massage device according to the invention.

FIG. 32 depict a support 2 such as described above with reference to FIG. 30. A plurality of massage members 1, for example, such as described with reference to FIG. 5*a* are joined to this support 2.

As shown in the example depicted in FIG. 32, at least two massage members 1 are arranged adjacent to one another. In other words, at least two massage members 1 are arranged side by side. These at least two massage members may extend either along different non parallel, or secant, axes of rotation, or along a coincident, including common, axis of rotation. By "non parallel," what is meant generally is that, considering the axes of rotation of two massage members, no plane including one of the axes of rotation can be parallel to a plane including the other axis of rotation. When the axes of rotation are secant, these axes may or may not be coplanar.

The depicted device comprises three massage members 1 that extend along one and the same axis of rotation Y. As shown, the central massage member may have a helix pitch that is reversed relative to the helix pitch of the massage members that surround it. The number of massage members arranged on this axis may be modified to two, four, five, or more.

FIGS. 33 to 44 show various embodiments of a massage device including at least two massage members 1 mounted on a support 2 and rotating about different axes of rotation. Such an embodiment thus allows the massage members to rotate about their respective axis of rotation independently of one another.

For example, the massage device may include two massage members that extend on both sides of a bearing. This bearing may include a post 24 to which the massage members are connected. The post may extend in a substantially central manner relative to the two massage members. The massage members may be images of one another relative to a plane of symmetry that passes through the post 24. The massage members may also be images of one another relative to a plane of symmetry that passes through a main axis of elongation of the gripping means or body 20.

Figure 33:
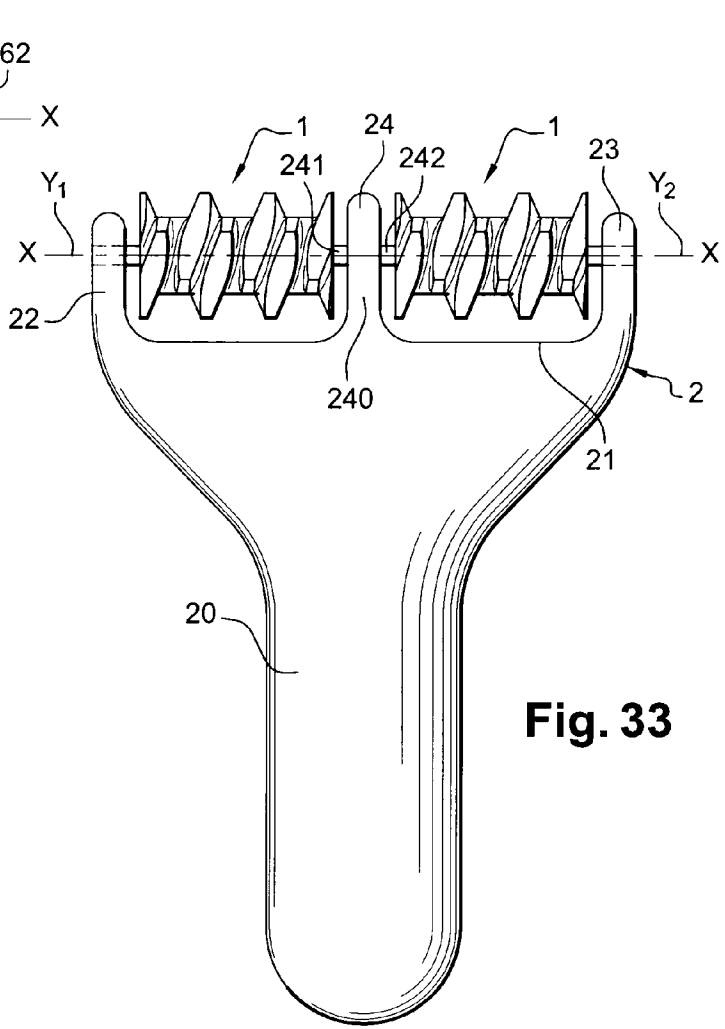
FIG. 33 is a schematic front view of another embodiment of a massage device according to the invention.

In FIG. 33, the support 2 is thus differentiated from the support represented in FIGS. 30 to 32 in that it comprises a third post 24 that extends from the end 21 of the body 20. This post 24 extends between the posts 22 and 23, for example in a median position between the two.

The post 24 may be provided with respective orifices 241, 242 on both sides. These orifices may extend, respectively, opposite the orifices 221, 231, of the posts 22 and 23.

The posts 22 and 24 may support an axis of rotation Y1 and the posts 23 and 24 may support an axis of rotation Y2. The axes of rotation may define, between them, an angle $\gamma$ of 180°.

In this exemplary embodiment, the massage members 1 mounted about the axes of rotation have a helix pitch oriented in the same direction.

The devices from FIGS. 34 to 41 are embodiment variants of the device described with reference to FIG. 33, only the differences between these embodiments and that of FIG. 33 will be mentioned in the remainder of the description.

Figure 34:
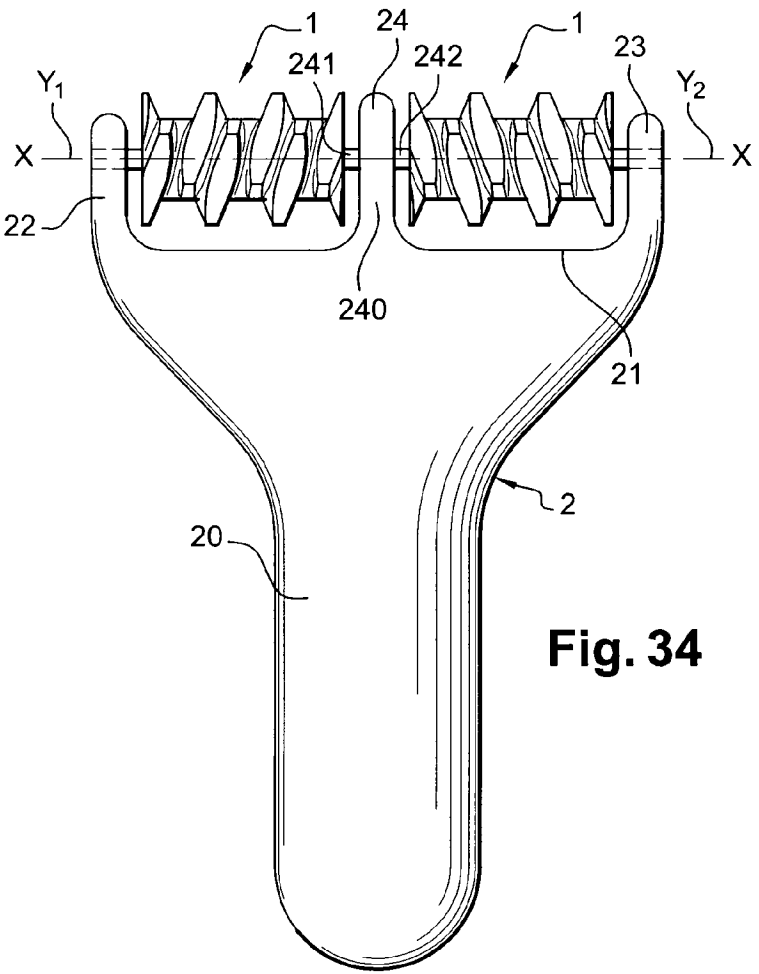
FIG. 34 is a schematic front view of another embodiment of a massage device according to the invention.

In FIG. 34, the massage device comprises two massage members 1 that have a helix pitch that is reversed from one relative to the other. These helix pitches are oriented towards one another. Such a device makes it possible to effectively fold the skin surface between the two massage members 1.

Figure 35:
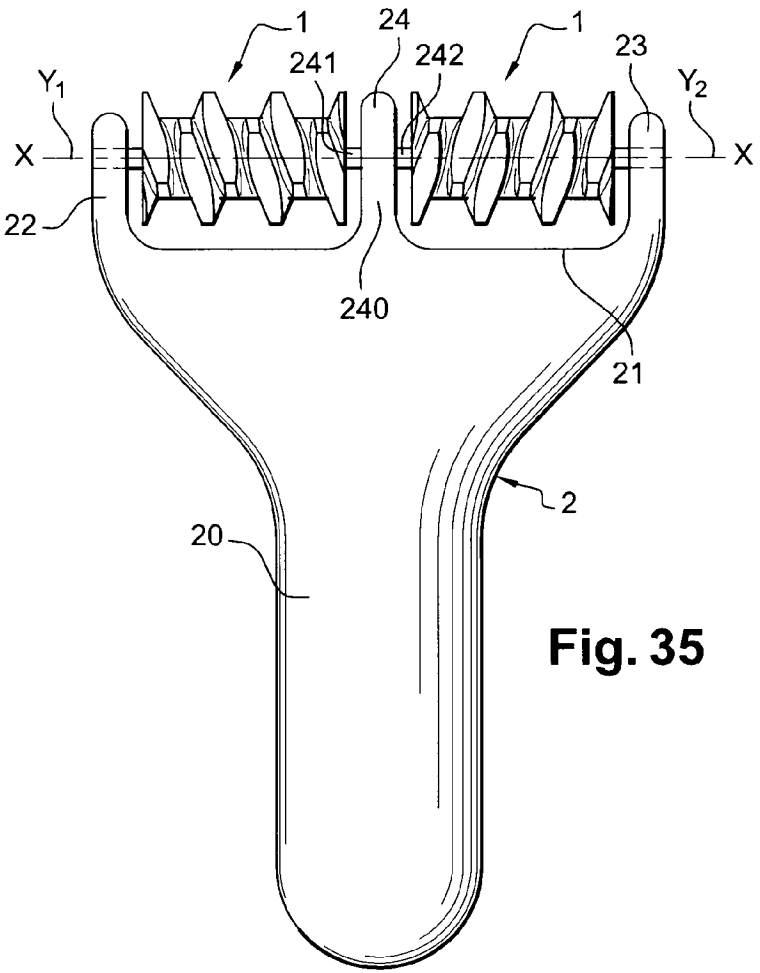
FIG. 35 is a schematic front view of another embodiment of a massage device according to the invention.

In FIG. 35, the massage device includes two massage members 1 that have a helix pitch that is reversed from one relative to the other. These helix pitches are oriented away from one another. Such a device makes it possible to effectively stretch the skin surface between the two massage members 1.

Figure 36:
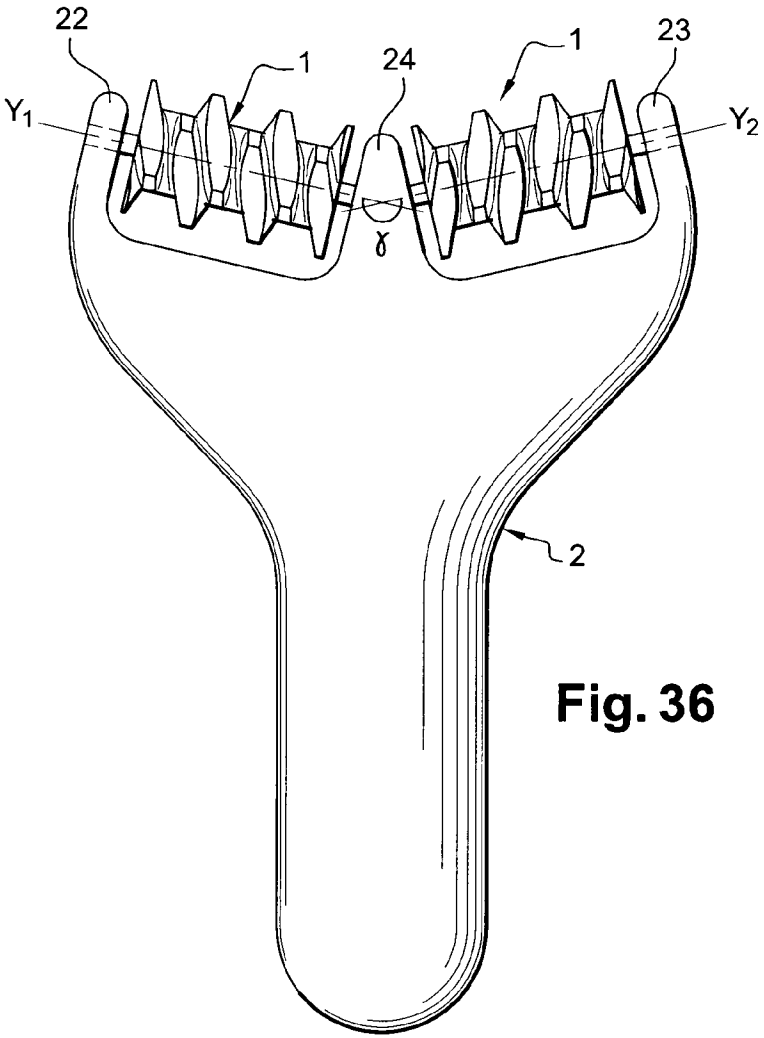
FIG. 36 is a schematic front view of another embodiment of a massage device according to the invention.

In FIG. 36, the massage device includes two massage members 1 having axes of rotation Y1, Y2 that together define an angle γ greater than 180°. This angle is around 220°. The angle is preferably between 190 and 320° and more preferably between 210 and 280° and more preferably still between 220 and 250°. It should be noted that the posts 22, 23 may be oriented towards one another.

Figure 37:
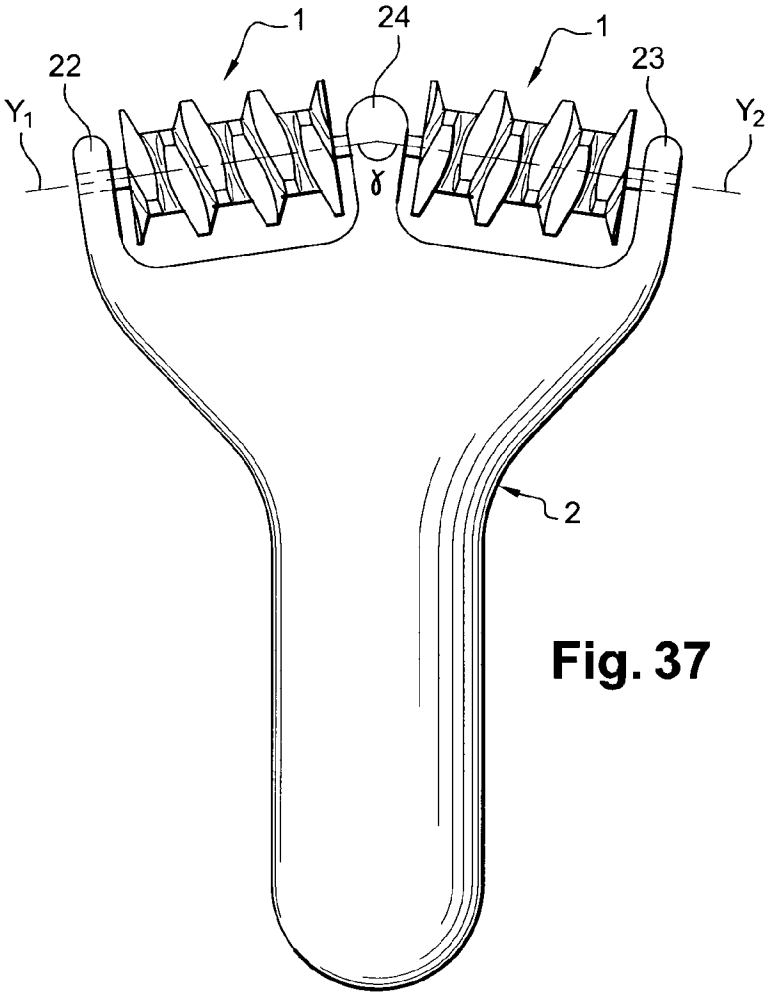
FIG. 37 is a schematic front view of another embodiment of a massage device according to the invention.

In FIG. 37, the massage device includes two massage members 1 having axes of rotation Y1, Y2 that together define an angle γ of less than 180°. This angle is around 140°. Such an angle is preferably between 50 and 170° and more preferably between 70 and 160° and more preferably still between 100 and 150°. It should be noted that the posts 22, 23 may be oriented away from one another as shown in the depicted example.

Figure 38:
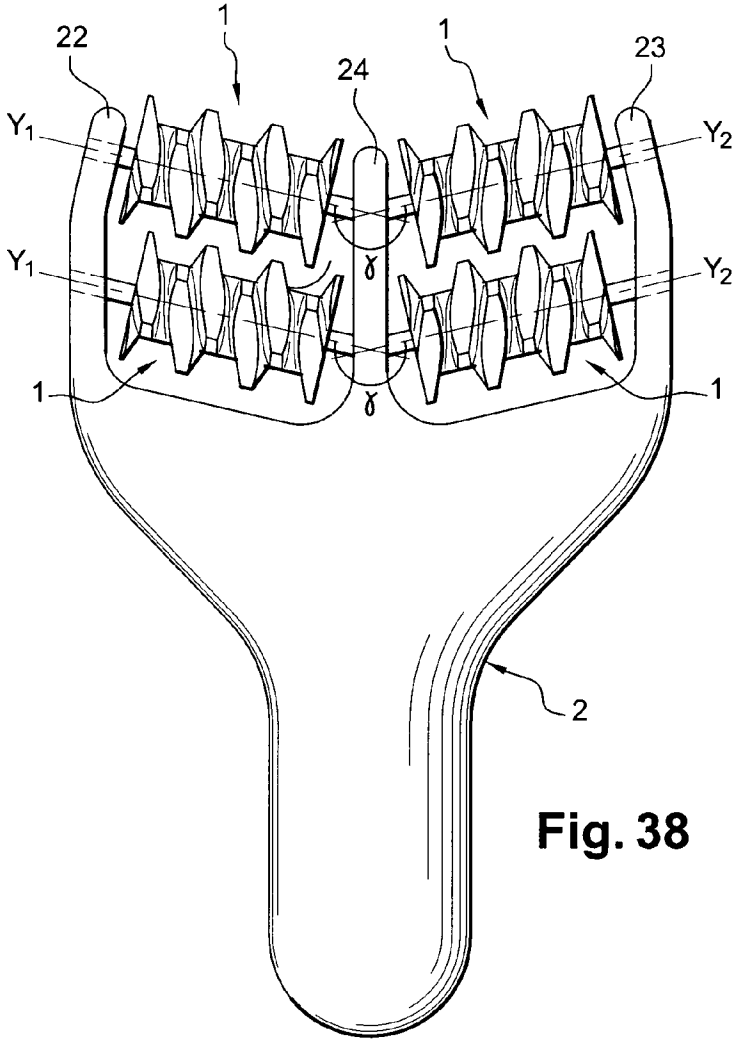
FIG. 38 is a schematic front view of another embodiment of a massage device according to the invention.

In FIG. 38, the massage device includes four massage members 1. For example, this device may include two pairs of massage members that extend at two different axial heights relative to the support 2. The constituent massage members of each pair may, for example, be arranged as in the embodiment described with reference to FIG. 36.

The two constituent massage members of one pair may, for example, have a helix pitch reversed from one relative to the other and is oriented towards one another. The two constituent massage members of the other pair may also have a helix pitch, reversed from one relative to the other, which is oriented away from one another. This exemplary embodiment is not limiting.

Figure 39:
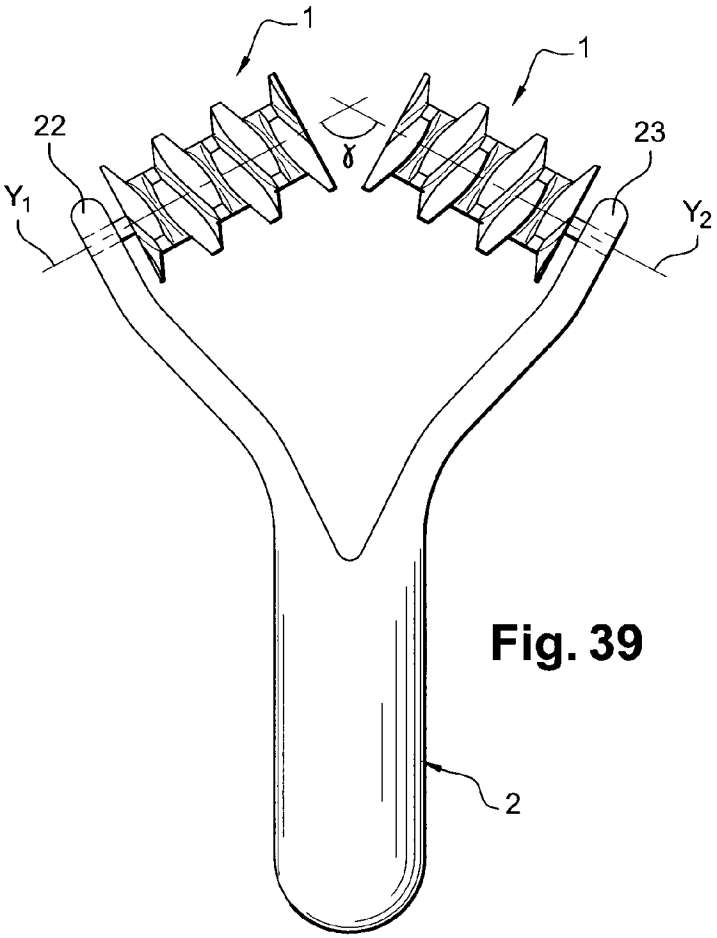
FIG. 39 is a schematic front view of another embodiment of a massage device according to the invention.

In the example depicted in FIG. 39, the massage device represented substantially corresponds to the massage device described with reference to FIG. 37 except that this device is, in this case, lacking the central post 24. The rotational axes of the massage members are thus only anchored to a single respective post 22, 23. Thus, the axis of rotation Y1 is thus only supported by the post 22. The axis of rotation Y2 is itself only supported by the post 23.

The absence of the post 24 and the orientation of the posts 22, 23 away from one another typically gives the posts 22, 23 a certain flexibility. The posts may then be moved relative to one another in the direction of an increase of their separation during a massage. Such posts can furthermore be made from an elastically deformable material. Such a flexibility enables the massage members to better match the relief of the massaged skin surface.

Figure 40:
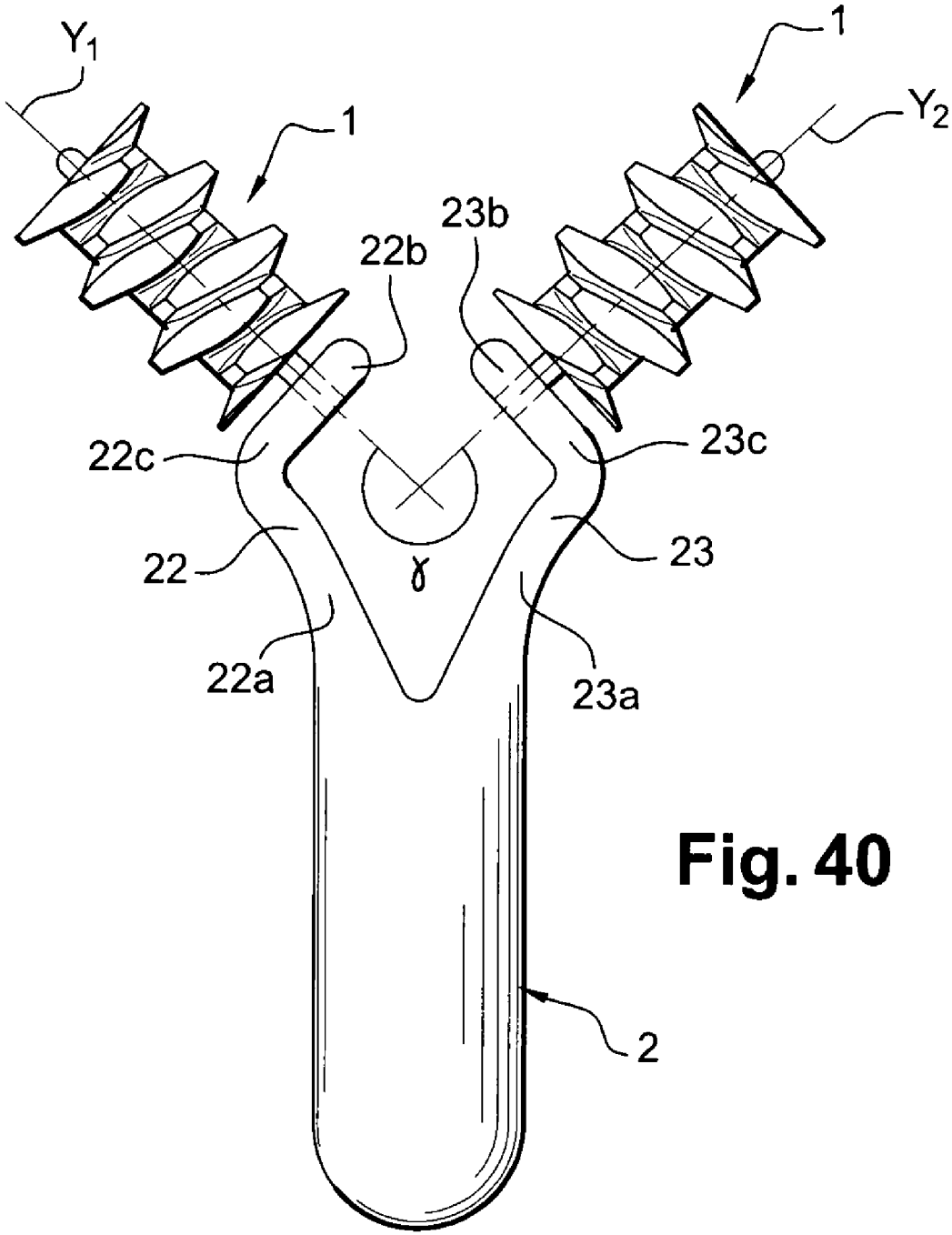
FIG. 40 is a schematic front view of another embodiment of a massage device according to the invention.

In FIG. 40, the massage device is differentiated from that described with reference to FIG. 39 in that the posts 22, 23 have an inverted curvature portion 22*c*, 23*c*, respectively. In the depicted example, the posts 22, 23 include a first respective portion 22*a*, 23*a* oriented away from one another connected to a second respective portion 22*b*, 23*b* oriented towards one another. As shown in FIG. 40, the massage members 1 may both extend on the outside of the posts 22, 23. For example, the massage members may be anchored to the second portion 22*b*, 23*b* of the post. The angle γ may be greater than 180°.

Generally, it should be noted that the axes of rotation Y1 and Y2 may both extend in one and the same plane. This plane may be parallel to the resting plane of the device.

In one example, the axes of rotation both define, with the resting plane of the device, a respective angle, for example between 5 and 45°. Such a characteristic makes it possible to easily vary the massage force applied to a given body surface.

FIGS. 41 to 44 show other embodiments of a massage device according to the present invention. Such devices are particularly suitable for massaging the arch of the foot or the back. These devices all comprise in this example eight massage members 1. A lower or higher number of massage members could be used. These massage members are mounted on a support denoted by the reference 2'. It comprises a frame 20' receiving one end of the axes of rotation of each massage member 1.

Figure 41:
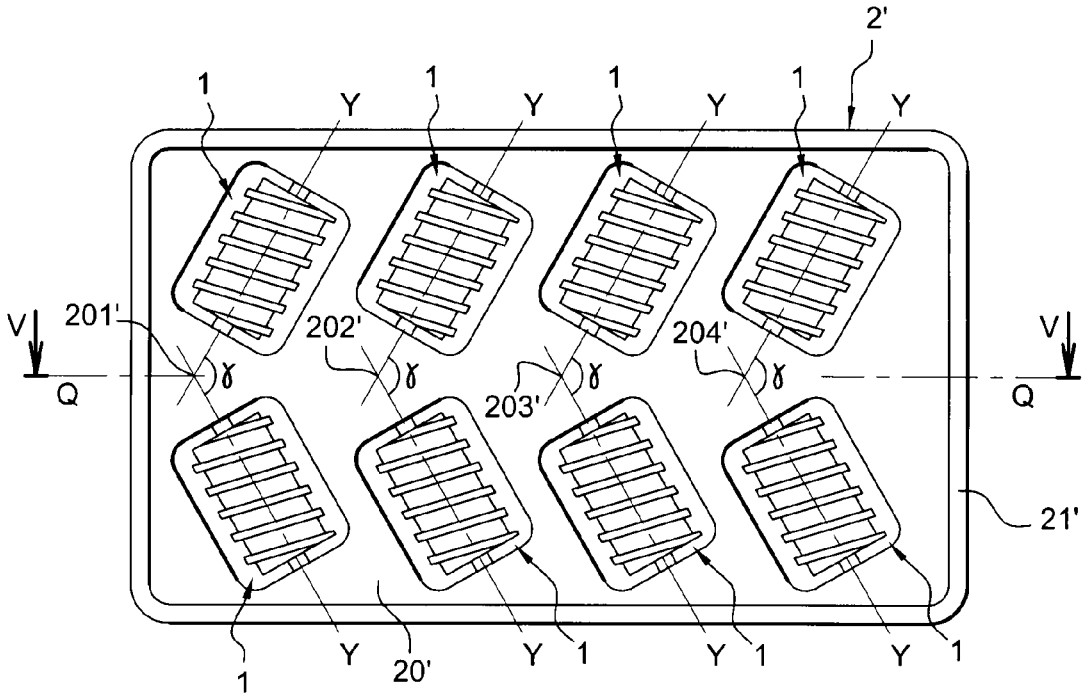
FIG. 41 is a schematic front view of another embodiment of a massage device according to the invention.
Figure 42:
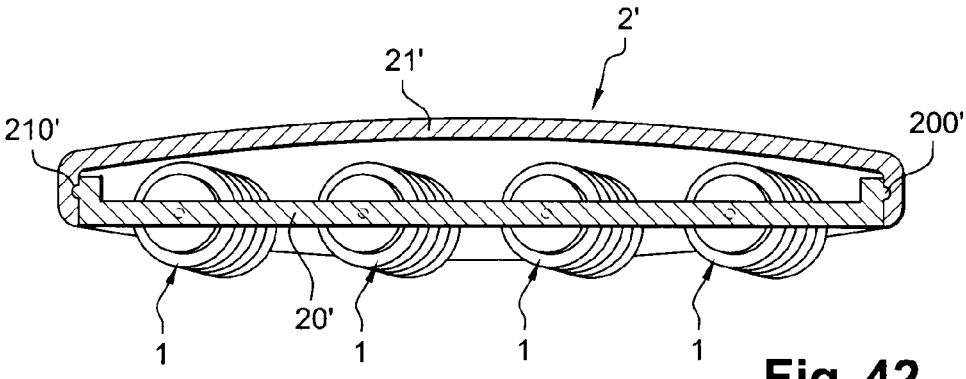
FIG. 42 is a schematic longitudinal cross-sectional view of the massage device represented in FIG. 41 along the V-V section plane.

As shown in FIG. 41, the frame may extend along a longitudinal axis Q. The massage members 1 may be positioned overall in two rows parallel to axis Q. The massage members may be arranged in pairs positioned along the longitudinal axis of the frame 20'. Each constituent member of such a pair may extend on both sides of the axis Q.

In one example, all the massage members 1 are mounted in free rotation, on the frame 20', about respective axes of rotation Y. Such axes may bisect each other at a plurality of intersection points 201', 202', 203', 204'. These intersection points may define a straight line contained in the axis Q.

The axes of rotation of the constituent massage members of one pair may together define a respective angle γ. In one example, the angles γ of each pair of massage members are all equal. These angles may, for example, be 140°.

The massage members 1 of one row may all have one and the same orientation. Additionally, they may be symmetrical to the massage members of the other row relative to this axis Q. Furthermore, the massage members 1 of the same row may be positioned at regular spacing relative to the plane Q.

The frame 20' and also the massage members 1 are typically covered by a casing component 21' that forms a cover and gripping means for a user's hand. This casing component 21' is typically attached to the frame 20'. To facilitate this attachment, the frame 20' may comprise a ridge 200' capable of being snap-fastened into a corresponding housing 210' of the casing component.

The massage members 1 of the same row may have a helix pitch that is reversed relative to the massage members 1 of the other row. For example, the helix pitch of the massage members of one row may be oriented away from the helix pitch of the massage members of the other row.

As a variant, the helix pitches of the massage members of the two rows may be oriented towards one another. According to another variant, the massage members 1 of the two rows may all have a helix pitch oriented in the same direction.

Figure 43:
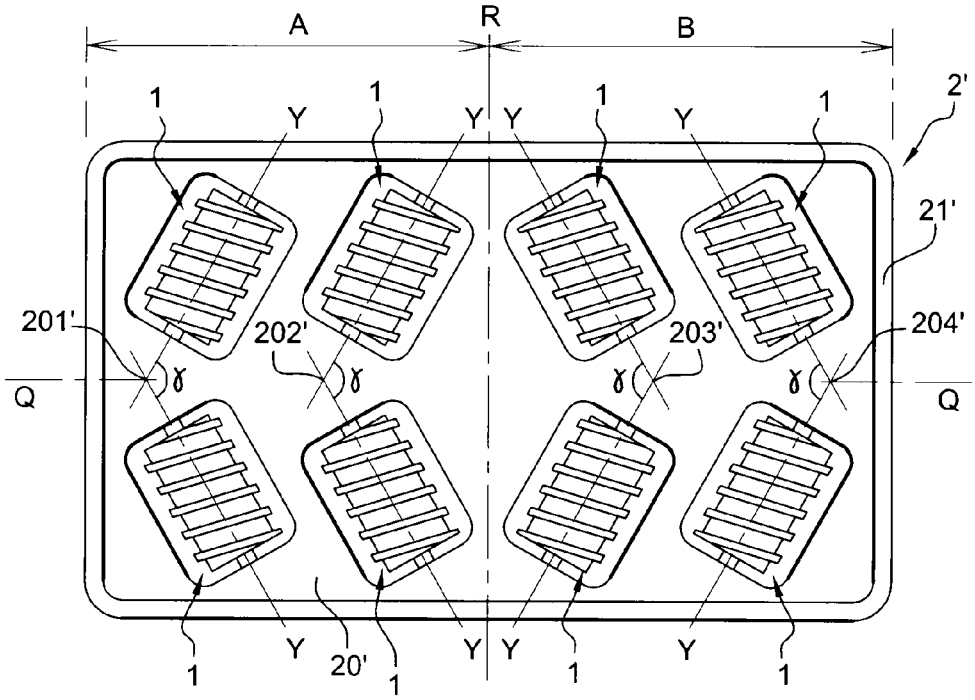
FIG. 43 is a schematic front view of another embodiment of a massage device according to the invention.

The embodiment shown in FIG. 43 is differentiated from that described with reference to FIG. 41 in that it comprises a different general arrangement of the massage members. The device includes, in this example, an arrangement A including a first and a second pair of massage members that have a similar general orientation. It also includes an arrangement B comprising a third and fourth pair of massage members that have a similar general orientation different from the arrangement A. More specifically, the arrangement A is symmetrical to the arrangement B relative to a plane R. The massage members of the arrangement A may be turned towards a side edge 20'*a* of the frame. The massage members of the arrangement B may be turned towards an opposite side edge 20'*b* of the frame. The plane R may bisect the Q axis orthogonally. This plane R may bisect the length of the frame in a median manner.

The device depicted in FIG. 43 has the advantage of providing a massage effect on the skin that is identical irrespective of its longitudinal displacement direction on the skin.

Figure 44:
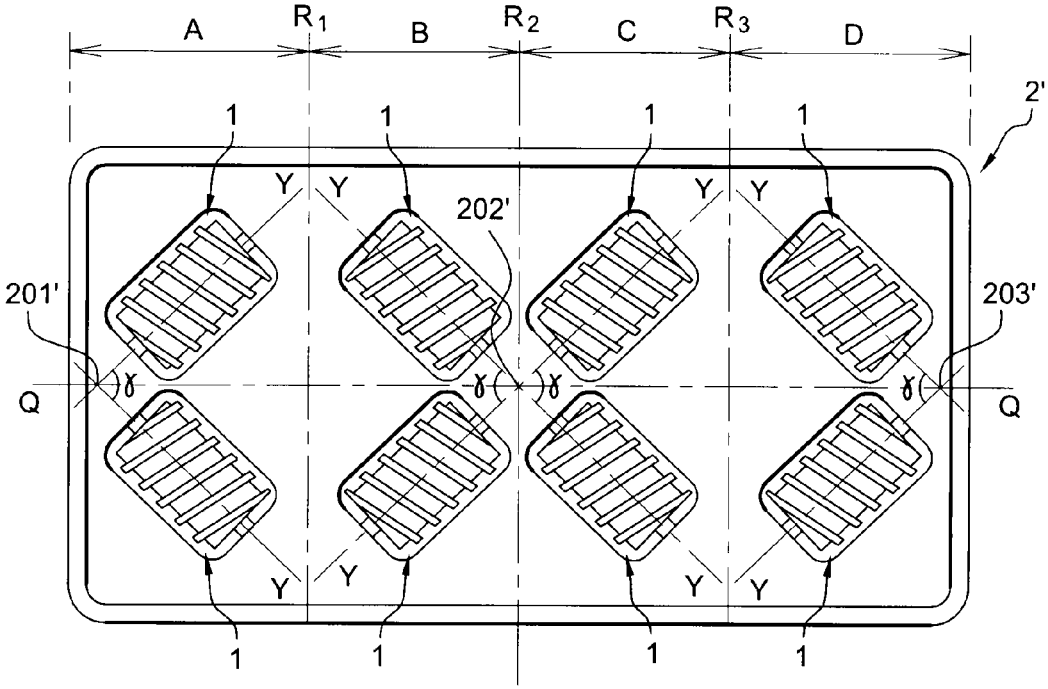
FIG. 44 is a schematic front view of another embodiment of a massage device according to the invention.

The embodiment depicted in FIG. 44 is differentiated from that described with reference to FIG. 41 in that it includes a first, a second, a third, and a fourth pair of massage members that have a respective arrangement A, B, C, D. The arrangements A and C are identical. The arrangements B and D are identical. The massage members of the arrangements A and C may be turned towards the side edge 20'*a* of the frame while the massage members of the arrangements B and D may be turned towards its opposite side edge 20'*b*.

The arrangement A may be symmetrical to the arrangement B relative to a plane R1. The arrangement B may be symmetrical to the arrangement C relative to a plane R2. The arrangement C may be symmetrical to the arrangement D relative to a plane R3. The planes R1, R2, and R3 may be parallel to one another. These planes R1, R2, and R3 may bisect the Q axis orthogonally. The planes R1, R2, and R3 may be equidistant from one another. Thus, the various pairs of massage members may have an orientation that alternates from one to the other.

Some examples of the invention provide a massage device containing more than four pairs of massage members. These members, thus combined, may then form a sort of mesh that is repeated in the longitudinal and transverse directions of the device. The massage action of the massage members of such a device is then substantially identical whether the device is moved in a longitudinal direction or in a transverse direction.

FIGS. 45 to 49 represent different examples of a packaging and dispensing assembly according to the present invention that incorporate a massage device according to the invention.

This packaging and dispensing assembly includes a product container 3. The product contained inside may be a cosmetic product. Such a product may, for example, be a lotion, a moisturizing milk, an essential oil, an anti-wrinkle cream or other. The container 3 may be made from an elastically deformable material or from a rigid material.

In the depicted example, the container 3 includes a first end 30 connected to a second opposite end 31 by a sleeve 32. This sleeve may, for example, have an oblong, and in particular oval, cross-section.

Figure 45:
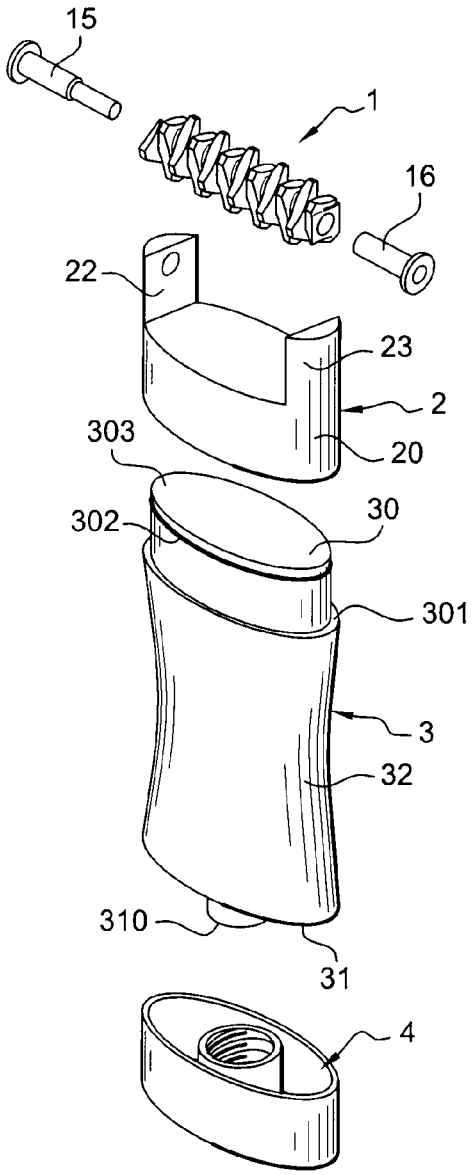
FIG. 45 is a slightly exploded schematic side view of an embodiment of a packaging and dispensing assembly according to the present invention.

In FIG. 45, the sleeve 32 includes, in the vicinity of the first end 30, a step 301 from which an attachment skirt 302 extends that leads to a platform 303.

The sleeve 32 of the container may be grasped by a user's hand in order to maneuver the massage device.

Figure 46:
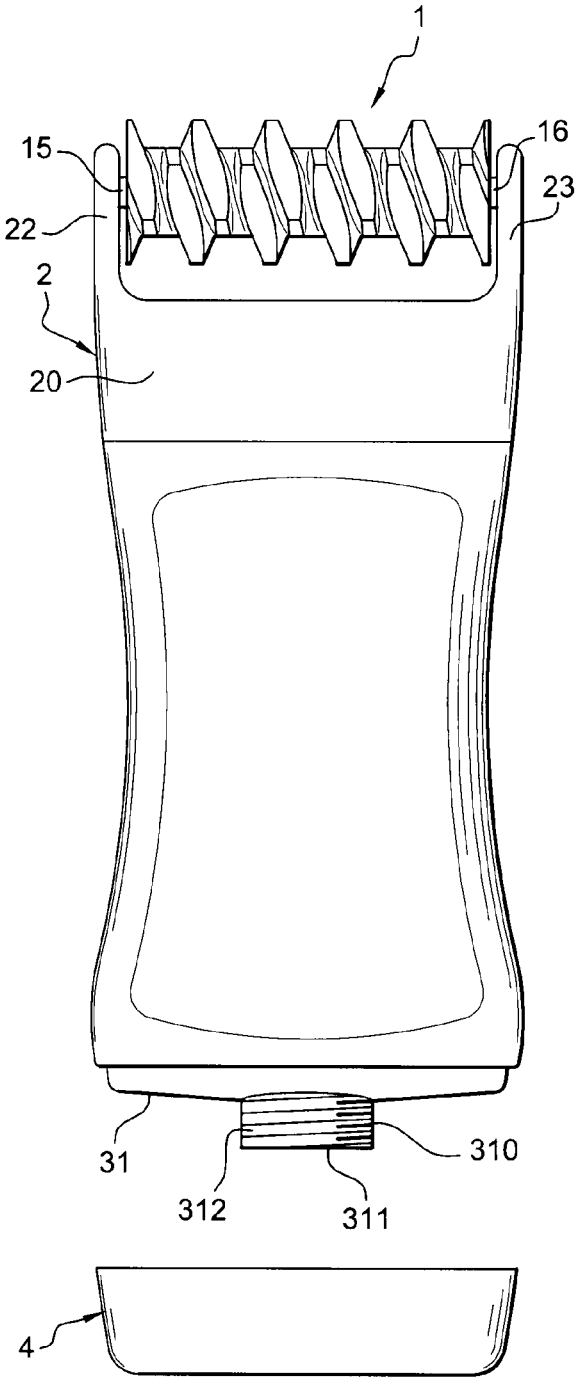
FIG. 46 is a schematic front view of the packaging and dispensing assembly represented in FIG. 45.

As can be seen in FIG. 46, the massage device may be joined to the container 3 by tightly fitting the body 20 of the support 2 around the attachment skirt 302. As a variant, this support can be snap-fastened or screwed to this skirt. Such a container may thus be joined to the massage device in a removable manner. This container may therefore be provided in the form of a refill.

In the depicted example, the second end 31 includes a dispensing member 310. The dispensing member may include a simple net that defines, inside, an outlet channel that leads directly into a dispensing orifice 311.

This dispensing orifice 311 may be sealed by a cover 4. This cover may be attached to the container 3 by any suitable means 312. In this example, the dispensing member is externally provided with a thread capable of receiving the cover 4 by screwing. However, the cover can also be a cover to be snap-fastened or crimped to the dispensing member.

Figure 47:
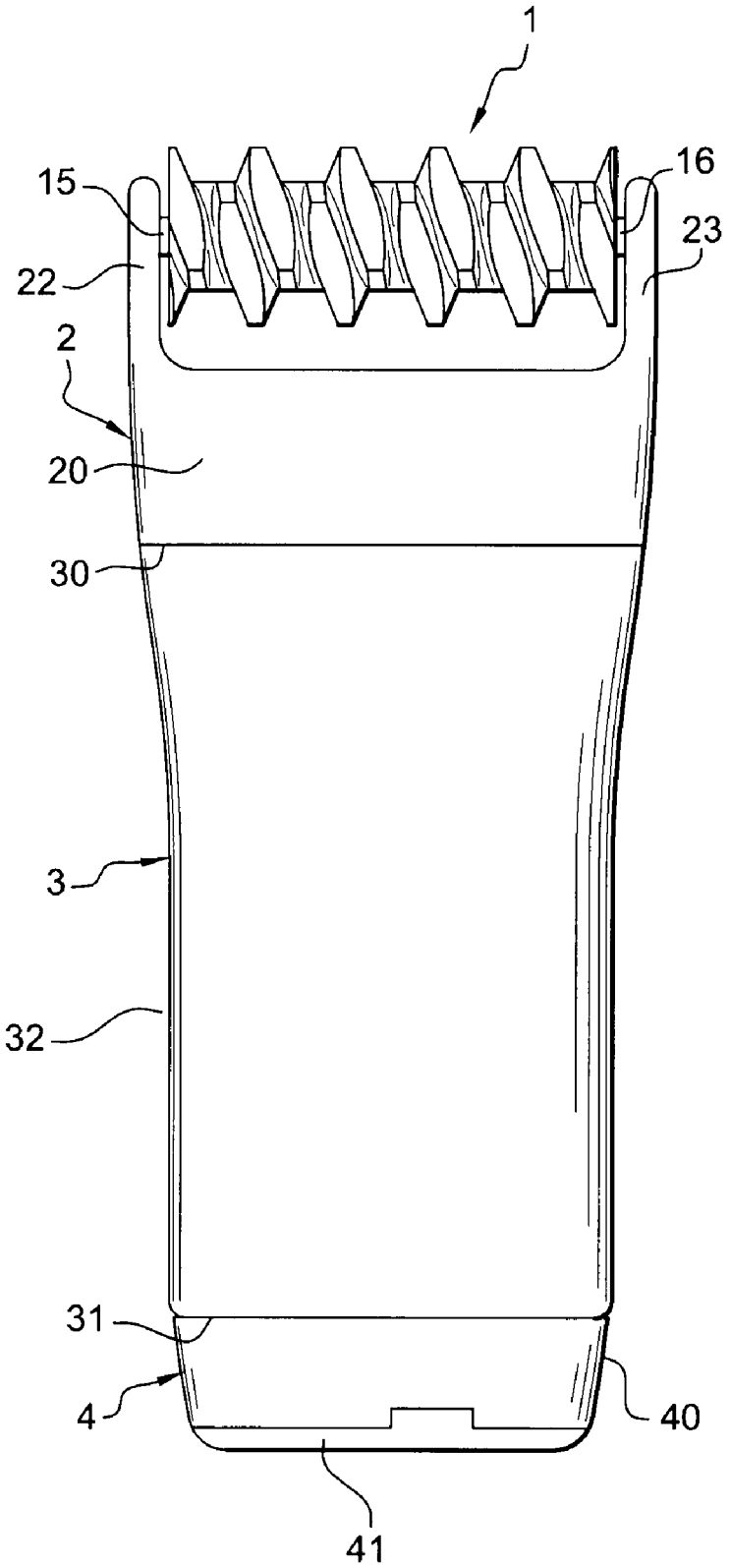
FIG. 47 is a schematic front view of another embodiment of a packaging and dispensing assembly according to the present invention.

In FIG. 47, the packaging and dispensing assembly is differentiated from that described with reference to FIGS. 45 and 46 in that it includes, as the cover for concealing the dispensing orifice, a cover 4.

The cover 4 includes a collar 40 and a lid 41.

The collar 40 may, for example, have a cross-section of substantially oval shape. It may include an open end and an opposite end sealed by a transverse wall through which a product dispensing orifice (not shown) passes.

This collar 40 may be mounted by any suitable means onto the second end 31 of the container 3, such as by snap-fastening. In the mounted position, the collar may extend straight on from the sleeve 32 of the container 3.

The lid 41 may include one substantially planar wall intended to bear against a resting surface when the assembly is not being used. This lid may be articulated in rotation about the collar by means of a film hinge or a hinge with an added axle (not shown). Such a lid may then be moved by the user between a position for sealing the dispensing orifice and a position for freeing the orifice.

Figure 48:
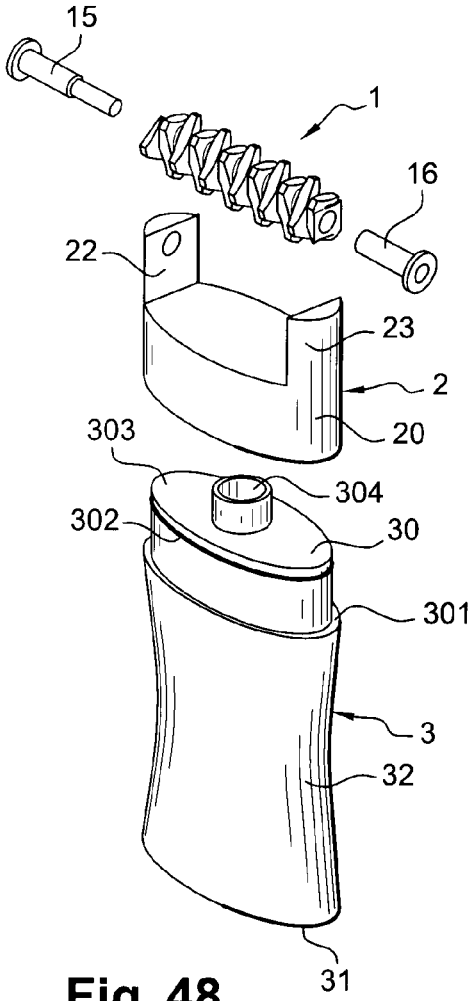
FIG. 48 is a schematic front view of another embodiment of a packaging and dispensing assembly according to the present invention.

In FIG. 48, the packaging and dispensing assembly is differentiated from that described with reference to FIGS. 45 and 46 in that it includes a dispensing orifice 304 at the first end 30 of the container 3. More specifically, this orifice may be cut into the platform 303. In such a case, the massage device and the dispensing orifice are therefore provided at one and the same end of the container 3. The support 20 may optionally act as a cover for sealing the orifice 4.

Figure 49:
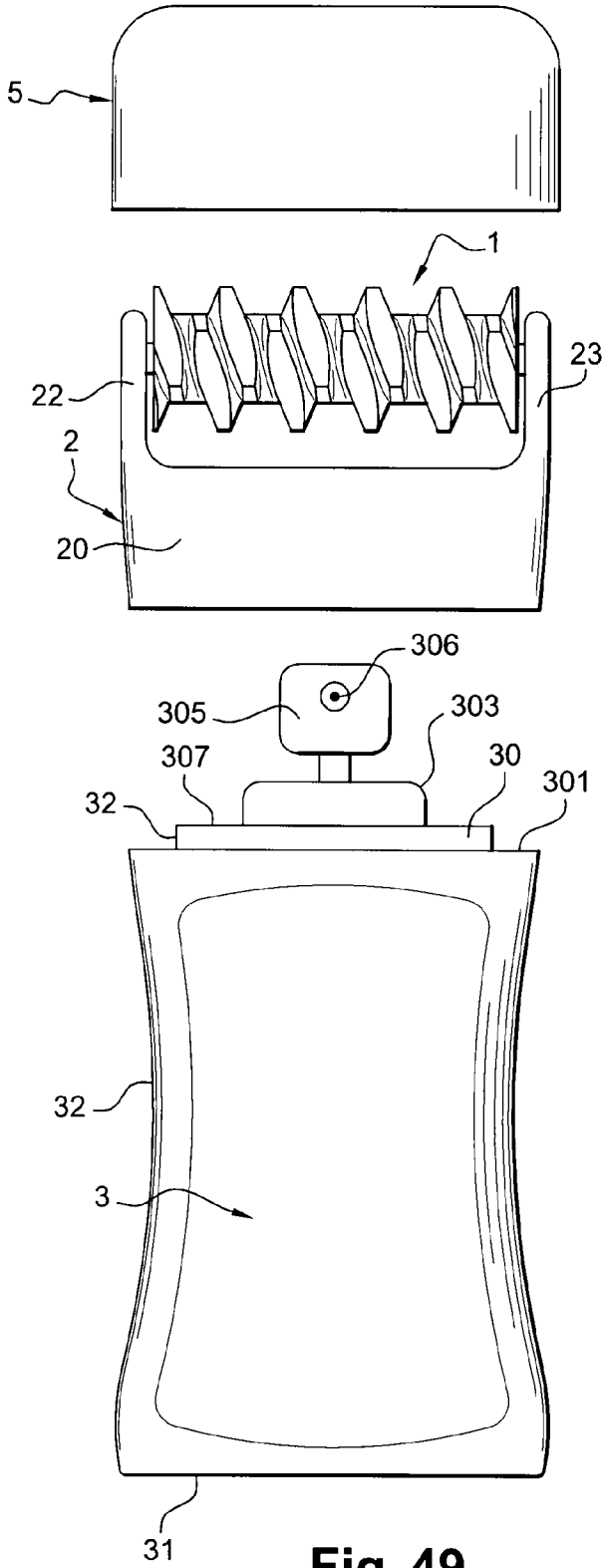
FIG. 49 is a schematic front view of another embodiment of a packaging and dispensing assembly according to the present invention.

In FIG. 49, the packaging and dispensing assembly is differentiated from that described with reference to FIG. 48 in that a dispensing system 305 is mounted in the outlet channel of the neck of the container. This dispensing system may be a conventional pump or valve. This system may be attached by means of a ring 307 to be screwed, snap-fastened, or crimped to the first end 31 of the container. Actuating such a system then leads to the dispensing, in jet form, of the product contained inside the container 3 through a dispensing orifice 306.

Moreover, an overcap 5 may optionally cover the massage device.

It should be noted that a packaging and dispensing assembly according to the present invention may include any one of the previously described massage devices combined with the container 3, according to any one of the methods described with reference to FIGS. 45 to 49. Such combinations are not limiting, other embodiments are available.

Figure 50:
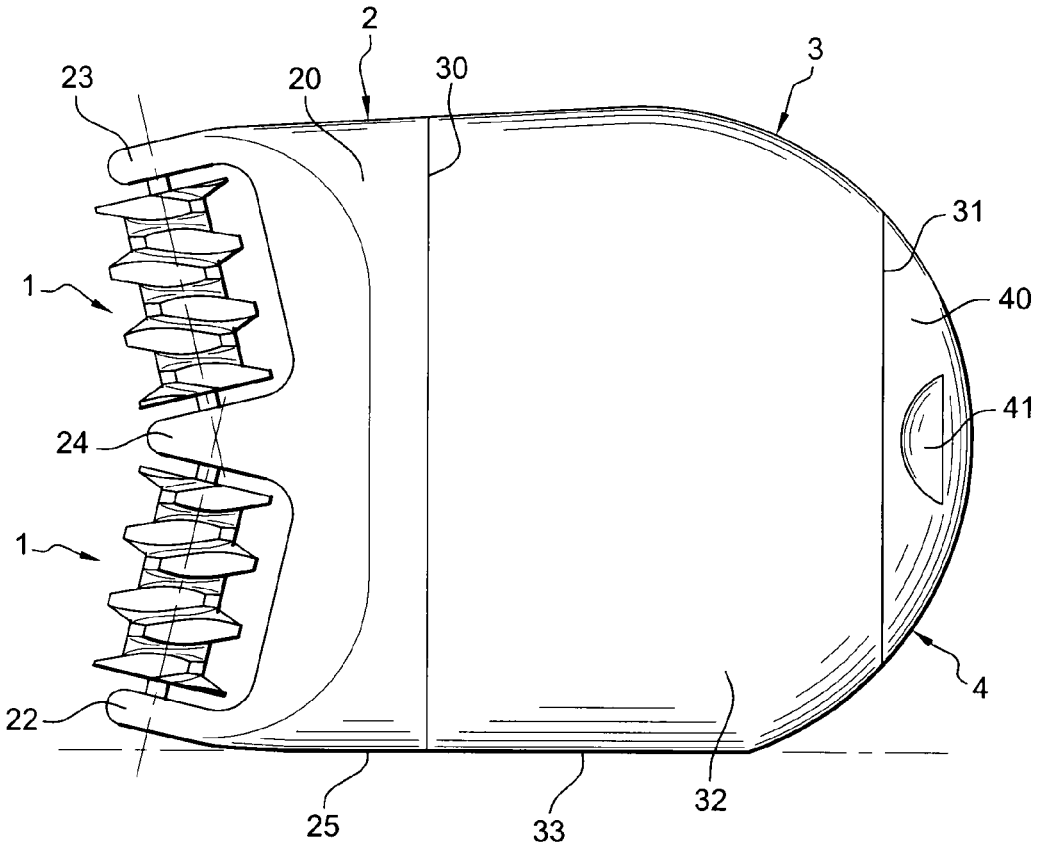
FIG. 50 is a schematic front view of another embodiment of a packaging and dispensing assembly according to the present invention.

For example, in example shown in FIG. 50, the massage device such as represented in FIG. 36 is combined with a container 3. This container 3 may be equipped with a cover 4 such as described with reference to FIG. 47. However, the lid 41 of this cover 4 may include a convex wall incapable of bearing against a resting surface when the assembly is not being used.

The packaging and dispensing assembly may include a planar portion or flat spot. This flat spot may be provided on one side of the assembly, preferably on a side with a larger dimension. This flat spot may thus extend parallel to an axis of elongation of the container. This axis of elongation may be secant, and especially orthogonal, to the dispensing orifice. The flat spot is able to bear against a resting surface.

For example, the container 3 may comprise a flat spot 33 capable of bearing against a resting surface. As a variant, or additionally, the body 20 of the support 2 may comprise a flat spot 25 able to bear against a resting surface. The flat spots 25 and 33 may optionally be in the extension of one another and thus form a substantially continuous bearing surface.

The present invention also relates to two different ways of using the packaging and dispensing assembly described previously.

The first includes a first step of coating a body surface with a cosmetic product and a second step of massaging the coated body surface.

The second includes a first step of massaging a body surface and a second step of coating the massaged body surface with a cosmetic product. The second usage mode thus makes it possible to prepare a body surface to be coated with product.

In both cases, the massage step makes it possible to promote the penetration of the product through the skin layers.

Throughout the description, the expression "comprise one" or "include one" should be considered as being synonymous with "comprise at least one" or "include at least one", unless specified to the contrary.

Obviously, numerous modifications and variations of the present invention are possible in light of the above teachings. It is therefore to be understood that within the scope of the appended claims, the invention may be practiced otherwise than as specifically described herein.

The invention claimed is:

1. A massage device comprising:

a support;

a grip firmly attached to the support and capable of being grasped in order for a user to handle the massage device; and at least two massage members rotatably mounted on the support around respective non parallel or coincident, including common, axes of rotation, the two massage members each including a roller that extends along a main axis of elongation, and massage components configured to bear against a skin surface, the massage components including free ends that project outwardly relative to the roller and that are arranged along at least one helix extending completely around the main axis of elongation of the roller, the massage components being distributed around at least one turn of the helix, said helix including an irregularity relative to the roller, wherein a distance between an outer edge of the massage components and a longitudinal axis of the roller varies along at least one turn of the helix.

2. The device according to claim 1, wherein the helix comprises a top ridge and the irregularity extends opposite the top ridge in a direction parallel to the axis of elongation of the roller.

3. The device according to claim 1, wherein first and second consecutive turns each comprise a top ridge and an irregularity relative to the roller, and the irregularity of the first turn is opposite the top ridge of the second turn in a direction parallel to the axis of elongation of the roller.

4. The device according to claim 1, wherein one turn comprises a top ridge and an irregularity relative to the roller, the irregularity extending opposite the top ridge in a direction parallel to the axis of elongation of the roller.

5. The device according to claim 1, further comprising a helical groove provided, on the main axis of elongation of the roller, between the massage components.

6. The device according to claim 5, wherein the groove extends into the thickness of the roller.

7. The device according to claim 5, wherein the free ends of the massage components define a free edge that protrudes outwardly substantially relative to the groove.

8. The device according to claim 1, wherein the free ends of the massage components define a free edge that protrudes outwardly relative to the roller.

9. The device according to claim 1, wherein the irregularity has, along the helix, a length greater than a diameter of the roller.

10. The device according to claim 9, wherein the diameter of the roller is an internal diameter.

11. The device according to claim 9, wherein the diameter of the roller is an external diameter.

12. The device according to claim 1, wherein the grip extends along a longitudinal axis that is transverse to the axes of rotation of the at least two massage members.

13. The device according to claim 1, wherein the at least two massage members comprise a first massage member and a second massage member that rotate about different respective axes of rotation.

14. The device according to claim 13, wherein the first and second massage members define between them a non-zero angle that is less than 180°.

15. The device according to claim 14, wherein the angle is less than 160°.

16. The device according to claim 15, wherein the angle is less than 140°.

17. The device according to claim 13, wherein the first and second massage members define first and second helix pitches, respectively, the first helix pitch being oriented in an opposite direction relative to the second helix pitch.

18. The device according to claim 1, wherein the free ends of each of the massage components are arranged in a double helix.

19. A packaging and dispensing assembly comprising a massage device according to claim 1, wherein the support is firmly attached to a product container equipped with a dispensing orifice.

20. The device according to claim 1, wherein the axes of rotation include first and second non-parallel axes.

21. The device according to claim 1, wherein the axes of rotation include first and second coincident axes.

22. A massage device comprising:

a support;

means for gripping attached to the support and capable of being grasped in order for a user to handle the massage device; and at least two massage members rotatably mounted on the support around respective non parallel or coincident, including common, axes of rotation, the two massage members each including a roller that extends along a main axis of elongation, and massage components configured to bear against a skin surface, the massage components including free ends that project outwardly relative to the roller and that are arranged along at least one helix extending completely around the main axis of elongation of the roller, the massage components being distributed around at least one turn of the helix, said helix including an irregularity relative to the roller wherein a distance between an outer edge of the massage components and a longitudinal axis of the roller varies along at least one turn of the helix.

* * * * *